US012560111B2

(12) United States Patent
Andrisani et al.

(10) Patent No.: US 12,560,111 B2
(45) Date of Patent: Feb. 24, 2026

(54) INTEGRATED ROCKER FOR ENGINE BRAKING WITH HYDRAULIC LASH ADJUSTER

(71) Applicant: Eaton Intelligent Power Limited, Dublin (IE)

(72) Inventors: Nicola Andrisani, Cumiana (IT); Emanuele Raimondi, Turin (IT); Massimo D'Amore, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/797,133

(22) Filed: Aug. 7, 2024

(65) Prior Publication Data

US 2024/0392704 A1 Nov. 28, 2024

Related U.S. Application Data

(63) Continuation of application No. PCT/EP2023/025060, filed on Feb. 9, 2023.
(Continued)

(51) Int. Cl.
*F01L 13/06* (2006.01)
*F01L 1/18* (2006.01)
(Continued)

(52) U.S. Cl.
CPC ..... *F01L 13/065* (2013.01); *F01L 1/181* (2013.01); *F01L 1/2416* (2013.01); *F01L 1/26* (2013.01); *F01L 2001/186* (2013.01)

(58) Field of Classification Search
CPC ..... F01L 1/181; F01L 13/065; F01L 13/06; F01L 1/24; F01L 1/2416; F01L 1/26; F01L 2001/467
See application file for complete search history.

(56) References Cited

U.S. PATENT DOCUMENTS 4,644,914 A 2/1987 Morita
5,193,497 A 3/1993 Hakansson
(Continued)

FOREIGN PATENT DOCUMENTS

CN 105507974 A 4/2016
DE 19914046 A1 * 9/2000 ..... F01L 1/181
(Continued)

OTHER PUBLICATIONS

DE-19914046-A1, English Language Machine Translation (Year: 2000).*
(Continued)

*Primary Examiner* — Wesley G Harris
(74) *Attorney, Agent, or Firm* — Baker Botts L.L.P.

(57) ABSTRACT

An exhaust valve rocker arm assembly selectively operable in an engine braking mode includes a rocker arm and a valve end configured to selectively act on a valve bridge to engage a first and a second exhaust valve. The valve end includes a brake capsule to selectively extend in a first position to act on the first exhaust valve through the valve bridge. The valve end also includes a lost motion mechanism capable of selectively transmitting motion of the rocker arm to the valve bridge. The lost motion mechanism may integrate a hydraulic lash adjuster in particular embodiments.

20 Claims, 21 Drawing Sheets

Related U.S. Application Data

(60) Provisional application No. 63/267,801, filed on Feb. 10, 2022.

(51) Int. Cl.
*F01L 1/24* (2006.01)
*F01L 1/26* (2006.01)

(56) References Cited

U.S. PATENT DOCUMENTS

| | | | | |
|---|---|---|---|---|
| 5,682,849 | A | 11/1997 | Regueiro | |
| 5,806,477 | A | 9/1998 | Regueiro | |
| 6,234,143 | B1 | 5/2001 | Bartel | |
| 6,386,160 | B1 | 5/2002 | Meneely | |
| 6,431,129 | B1 | 8/2002 | Hammoud | |
| 7,284,533 | B1 | 10/2007 | Huang | |
| 7,617,807 | B2 | 11/2009 | Diggs | |
| 7,900,597 | B2 | 3/2011 | Meneely | |
| 7,905,208 | B2 | 3/2011 | Ruggiero | |
| 8,037,865 | B2 | 10/2011 | Meneely | |
| 8,272,363 | B2 | 9/2012 | Meneely | |
| 8,499,740 | B2 | 8/2013 | Yoon | |
| 8,627,791 | B2 | 1/2014 | Janak | |
| 8,800,531 | B2 | 8/2014 | Wiley | |
| 9,016,249 | B2 | 4/2015 | Roberts | |
| 9,470,116 | B2 | 10/2016 | Cecur | |
| 10,247,064 | B2 | 4/2019 | Cecur | |
| 10,823,018 | B1 | 11/2020 | Berndt | |
| 11,015,493 | B2 | 5/2021 | Cecur | |
| 11,339,690 | B2 | 5/2022 | Vanwingerden | |
| 2001/0003280 | A1 | 6/2001 | Yang | |
| 2005/0211206 | A1 | 9/2005 | Ruggiero | |
| 2006/0225684 | A1 | 10/2006 | Spath | |
| 2007/0144472 | A1 | 6/2007 | Yang | |
| 2008/0087239 | A1 | 4/2008 | Wiley | |
| 2009/0266317 | A1 | 10/2009 | Meacock | |
| 2010/0024767 | A1 | 2/2010 | Meneely | |
| 2011/0073068 | A1 | 3/2011 | Yoon | |
| 2011/0162620 | A1 | 7/2011 | Bidner | |
| 2012/0024260 | A1 | 2/2012 | Groth | |
| 2012/0048232 | A1 | 3/2012 | Meistrick | |
| 2012/0298057 | A1 | 11/2012 | Janak | |
| 2014/0083381 | A1 | 3/2014 | Roberts | |
| 2014/0182533 | A1 | 7/2014 | Le | |
| 2014/0182536 | A1 | 7/2014 | Yang | |
| 2014/0326212 | A1 | 11/2014 | Baltrucki | |
| 2015/0144096 | A1 | 5/2015 | Meneely | |
| 2015/0159520 | A1 | 6/2015 | Cecur | |
| 2015/0285179 | A1 | 10/2015 | Cohn | |
| 2015/0354418 | A1 | 12/2015 | Jo | |
| 2015/0369087 | A1 | 12/2015 | Nielsen | |
| 2016/0056187 | A1 | 2/2016 | Lin | |
| 2016/0146074 | A1 | 5/2016 | Lynch | |
| 2016/0298508 | A1 | 10/2016 | Lahr | |
| 2017/0145944 | A1 | 5/2017 | Felix | |
| 2017/0175597 | A1 | 6/2017 | Cecur | |
| 2017/0241305 | A1 | 8/2017 | Xi | |
| 2017/0276034 | A1 | 9/2017 | Cecur | |
| 2017/0321576 | A1* | 11/2017 | Nielsen | F01L 13/06 |
| 2018/0003088 | A1 | 1/2018 | Nielsen | |
| 2018/0073401 | A1 | 3/2018 | Andrisani | |
| 2018/0087412 | A1 | 3/2018 | Andrisani | |
| 2018/0087413 | A1 | 3/2018 | Xi | |
| 2018/0298795 | A1 | 10/2018 | Cecur | |
| 2018/0306106 | A1 | 10/2018 | Glugla | |
| 2019/0010835 | A1 | 1/2019 | McCarthy | |
| 2019/0055861 | A1 | 2/2019 | Persson | |
| 2019/0145289 | A1* | 5/2019 | Ferreira | F01L 13/065 123/90.55 |
| 2019/0264584 | A1* | 8/2019 | Baltrucki | F01L 1/2416 |
| 2020/0088073 | A1 | 3/2020 | Baltrucki | |
| 2020/0182108 | A1 | 6/2020 | Vanwingerden | |
| 2020/0263571 | A1 | 8/2020 | Benn | |
| 2020/0325803 | A1 | 10/2020 | Patil | |
| 2021/0095584 | A1 | 4/2021 | Vanwingerden | |
| 2021/0372299 | A1* | 12/2021 | Edke | F01L 1/267 |

FOREIGN PATENT DOCUMENTS

| | | | | |
|---|---|---|---|---|
| DE | 10055014 | A1 | 5/2002 | |
| DE | 102008039504 | A1 * | 2/2010 | F01L 13/06 |
| DE | 102013215205 | A1 * | 2/2015 | F01L 13/065 |
| DE | 102016212480 | A1 | 1/2018 | |
| EP | 2653673 | A1 | 10/2013 | |
| JP | S63272929 | A | 11/1988 | |
| JP | 2004084596 | A | 3/2004 | |
| WO | WO 9108381 | A1 | 6/1991 | |
| WO | WO 2012113126 | A1 | 8/2012 | |
| WO | WO 2014006185 | A1 | 1/2014 | |
| WO | WO-2015120897 | A1 * | 8/2015 | F01L 1/16 |
| WO | WO 2015177127 | A1 | 11/2015 | |
| WO | WO 2016041600 | A1 | 3/2016 | |
| WO | WO-2016041882 | A1 * | 3/2016 | F01L 1/18 |
| WO | WO-2016184495 | A1 * | 11/2016 | F01L 1/18 |
| WO | WO 2017160379 | A1 | 9/2017 | |
| WO | WO-2019133658 | A1 * | 7/2019 | F01L 1/181 |
| WO | WO 2019195511 | A1 | 10/2019 | |
| WO | WO 2019228671 | A1 | 12/2019 | |
| WO | WO-2020229969 | A1 * | 11/2020 | F01L 1/053 |
| WO | WO 2022189042 | A1 | 9/2022 | |

OTHER PUBLICATIONS

DE-102013215205-A1, English language machine translation (Year: 2015).*
International search report and Written Opinion received for PCT Application No. PCT/US/EP2023/025060, 10 pages, May 8, 2023.
International search report and Written Opinion received for PCT Application No. PCT/EP2019/025180, 14 pages, Aug. 29, 2019.
International search report and Written Opinion received for PCT Application No. PCT/US2019/041649, 10 pages, Nov. 6, 2019.

* cited by examiner

INTEGRATED ROCKER FOR ENGINE BRAKING WITH HYDRAULIC LASH ADJUSTER

PRIORITY

This application is a continuation under 35 U.S.C. § 365(c) of International Patent Application No. PCT/EP2023/025060, filed on 9 Feb. 2023, which claims the benefit under 35 U.S.C. § 119 of U.S. Application No. 63/267,801, filed on 10 Feb. 2022, all of which are incorporated herein by reference.

TECHNICAL FIELD

The present disclosure relates generally to a rocker arm assembly for use in a valvetrain assembly, and more particularly to a rocker arm assembly that provides a compression brake function.

BACKGROUND

Compression engine brakes may be used as auxiliary brakes, in addition to wheel brakes, on relatively large vehicles powered by heavy or medium duty diesel engines. A compression engine braking system may be arranged, when activated, to provide early and/or additional opening of an engine cylinder's exhaust valve when the piston in that cylinder may be near a top-dead-center position of its compression stroke so that compressed air may be released through the exhaust valve. This may cause an engine to function as a power consuming air compressor, which may assist in slowing the vehicle.

In a typical valvetrain assembly used with a compression engine brake, one or more exhaust valves may be actuated by an exhaust rocker arm, which may engage one or more exhaust valves by means of a valve bridge. The exhaust rocker arm may rock in response to lift profiles of received from one or more rotating camshafts, and may accordingly press down on the valve bridge, which may itself press down on one or more of the exhaust valves to open them.

The description provided herein is for the purpose of generally presenting the context of the disclosure. Work of the presently named inventors, to the extent it is described in this section, as well as aspects of the description that cannot otherwise qualify as prior art at the time of filing, are neither expressly nor impliedly admitted as prior art against the present disclosure.

SUMMARY OF PARTICULAR EMBODIMENTS

In an embodiment, an exhaust valve rocker arm assembly is disclosed that is capable of selectively operating in one or more types of engine braking modes. In particular embodiments, the exhaust valve rocker arm assembly comprises a rocker arm configured to rotate about a rocker shaft; a valve end of the rocker arm configured to selectively act on a valve bridge, the valve bridge being configured to selectively engage a first exhaust valve and a second exhaust valve, the valve end of the rocker arm comprising a brake capsule disposed on the rocker arm, the brake capsule comprising a plunger body selectively movable between a first position and a second position, the plunger body extending in the first position to act on the first exhaust valve through the valve bridge; the valve end further comprising a lost motion mechanism disposed on the rocker arm, the lost motion mechanism comprising a lost motion shaft and a hydraulic lash adjuster integrated into the lost motion mechanism, the lost motion shaft configured to translate along a lost motion receiving passage for selectively transmitting motion of the rocker arm to the valve bridge.

In particular embodiments, which may combine the features of some or all above embodiments, the hydraulic lash adjuster integrated into the lost motion mechanism is configured to continually compensate for lash between the lost motion shaft and the valve bridge during operation of the exhaust valve rocker arm assembly in the engine braking enabled mode and the engine braking disabled mode.

In particular embodiments, which may combine the features of some or all above embodiments, in an engine braking mode, the plunger body of the brake capsule is extended in the first position, the plunger body acting on the valve bridge during rotation of the rocker arm to a first angle and opening the first exhaust valve a predetermined distance, the second exhaust valve remaining closed.

In particular embodiments, which may combine the features of some or all above embodiments, in an engine braking mode, subsequent to the opening of the first exhaust valve the predetermined distance, further rotation of the rocker arm causes the lost motion shaft to act on the valve bridge and open the second exhaust valve while further opening the first exhaust valve.

In particular embodiments, which may combine the features of some or all above embodiments, the brake capsule is a hydraulic brake capsule.

In particular embodiments, which may combine the features of some or all above embodiments, the hydraulic brake capsule comprises an actuator configured to selectively release oil pressure in the hydraulic brake capsule.

In particular embodiments, which may combine the features of some or all above embodiments, the plunger body occupying the first position is associated with providing pressurized oil through a controllable hydraulic line, the pressurized oil acting on the actuator.

In particular embodiments, which may combine the features of some or all above embodiments, the actuator comprises a needle and a check ball, the needle comprising a longitudinal pin portion and a disk portion, the needle configured to selectively open the check ball based on pressurized oil acting on the disk portion.

In particular embodiments, which may combine the features of some or all above embodiments, the exhaust valve rocker arm assembly further comprises an oil discharge circuit configured to selectively depressurize oil under the disk portion of the needle.

In particular embodiments, which may combine the features of some or all above embodiments, the lost motion mechanism is longitudinally aligned with the center of the valve bridge.

In particular embodiments, which may combine the features of some or all above embodiments, the brake capsule is longitudinally aligned with the first exhaust valve.

In particular embodiments, which may combine the features of some or all above embodiments, in an engine braking disabled mode, the plunger body is retracted to a second position and configured into a collapsible state, thereby preventing the plunger body from exerting a valve opening force on the valve bridge, and the first exhaust valve and the second exhaust valve follow an exhaust lift profile motion transmitted to the valve bridge by the lost motion mechanism.

In particular embodiments, which may combine the features of some or all above embodiments, the exhaust valve rocker arm further comprises a locking mechanism configured to selectively mechanically constrain the first plunger body to the second position in the engine braking disabled mode.

In particular embodiments, which may combine the features of some or all above embodiments, a method of operating a valvetrain system is disclosed, the valvetrain system comprising an exhaust valve rocker arm assembly, the method comprising, in an engine braking enabled mode, extending a plunger body of a brake capsule to a first position, the exhaust valve rocker arm assembly comprising the brake capsule and a lost motion mechanism, the plunger body in the first position acting on a valve bridge during rotation of a rocker arm to a first angle to open a first exhaust valve a predetermined distance, a second exhaust valve remaining closed, and causing a lost motion shaft of the lost motion mechanism to act on the valve bridge, subsequent to the opening of the first exhaust valve the predetermined distance and based on further rotation of the rocker arm, to open the second exhaust valve while further opening the first exhaust valve, while continually compensating for lash between the lost motion shaft and the valve bridge based on operation of a hydraulic lash adjuster integrated into the lost motion mechanism.

In particular embodiments, which may combine the features of some or all above embodiments, a method of operating a valvetrain system is disclosed wherein, in an engine braking disabled mode, the plunger body is retracted to a second position and a collapsible state, thereby preventing the plunger body from exerting a valve opening force on the valve bridge, and the first exhaust valve and the second exhaust valve are constrained to follow an exhaust lift profile motion transmitted to the valve bridge by the lost motion mechanism.

In particular embodiments, which may combine the features of some or all above embodiments, a valvetrain system of an engine is disclosed, the valvetrain system capable of selectively engaging an engine braking enabled mode or an engine braking disabled mode, the valvetrain system comprising an exhaust camshaft provided with an engine braking profile; an exhaust valve rocker arm assembly operatively coupled with the exhaust camshaft and selectively operable in at least an engine braking enabled mode and an engine braking disabled mode; a valve bridge; and a plurality of exhaust valves comprising at least one first exhaust valve and at least one second exhaust valve, the plurality of exhaust valves configured to be selectively acted upon by the valve bridge, wherein the exhaust valve rocker arm assembly further comprises a rocker arm configured to rotate about a rocker shaft; a brake capsule disposed on the rocker arm and comprising a plunger body selectively movable between a first position and a second position, the plunger body extending in the first position to act on the first exhaust valve through the valve bridge; and a lost motion mechanism disposed on the rocker arm comprising a lost motion shaft and a hydraulic lash adjuster integrated into the lost motion mechanism, the lost motion shaft configured to translate along a lost motion receiving passage for selectively transmitting motion of the rocker arm to the valve bridge.

BRIEF DESCRIPTION OF THE DRAWINGS

The present invention will be described in greater detail below based on the exemplary figures. The invention is not limited to the exemplary embodiments. Other features and advantages of various embodiments of the present invention will become apparent by reading the following detailed description with reference to the attached drawings which illustrate the following.

DESCRIPTION OF EXAMPLE EMBODIMENTS

In accordance with various embodiments of the present disclosure, rocker arm assemblies and related mechanisms, devices, and methodologies are provided herein. For clarity, not all features of each actual implementation or embodiment may be described in this specification. Modifications and/or combination of features and aspects may be made that result in embodiments that are fully contemplated to fall within the scope of this disclosure.

Figure 1:
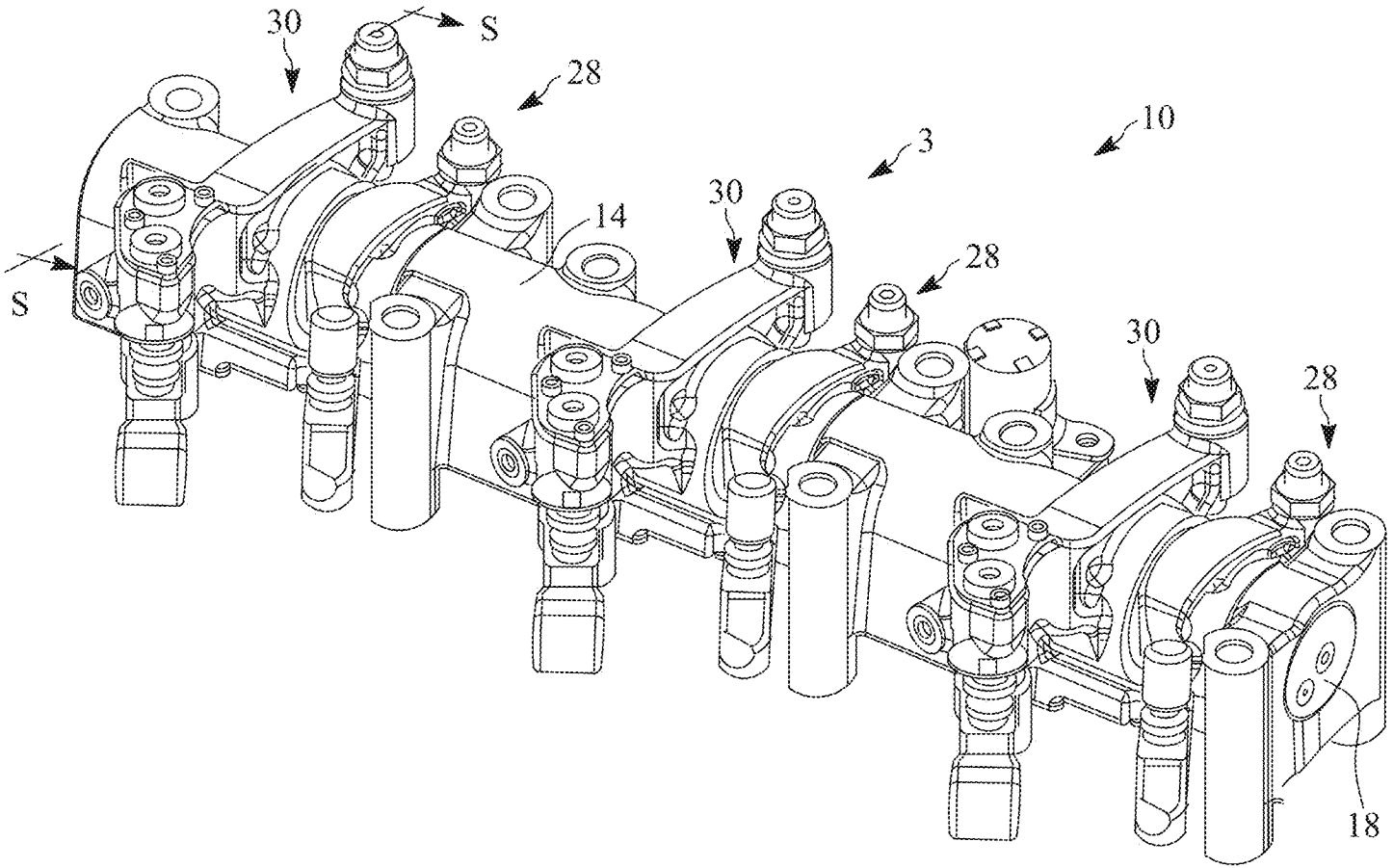
FIG. 1 illustrates a schematic perspective partial view of a valvetrain assembly incorporating a rocker arm assembly, including an exhaust rocker arm assembly for use with compression engine braking, according to particular embodiments. Particular sectional views disclosed and/or described herein may be taken along the S-S plane.

FIG. 1 illustrates a schematic perspective partial view of a valvetrain assembly 10 incorporating a rocker arm assembly 3, including an exhaust rocker arm assembly 30 for use with compression engine braking, according to particular embodiments. While the schematic illustrated may be shown to be configured for use in a three-cylinder bank portion of a six-cylinder engine as an example, it will be appreciated that the present teachings are not so limited, and may be adapted to a wide range of configurations. In this regard, the present disclosure may be used in any valvetrain assembly that may utilize engine braking.

The partial valvetrain assembly 10 may include a rocker assembly housing 14, which may support a rocker arm assembly 3 having a series of intake valve rocker arm assemblies 28 and a series of exhaust rocker arm assemblies 30. A rocker shaft 18 may be received by the rocker housing 14. As will be described in detail herein, the rocker shaft 18 may cooperate with the rocker arm assembly 3 and more specifically with the exhaust rocker arm assemblies 30. In particular embodiments, rocker shaft 18 may separately or additionally communicate oil to the exhaust rocker arm assemblies 30 during engine braking.

Figure 2:
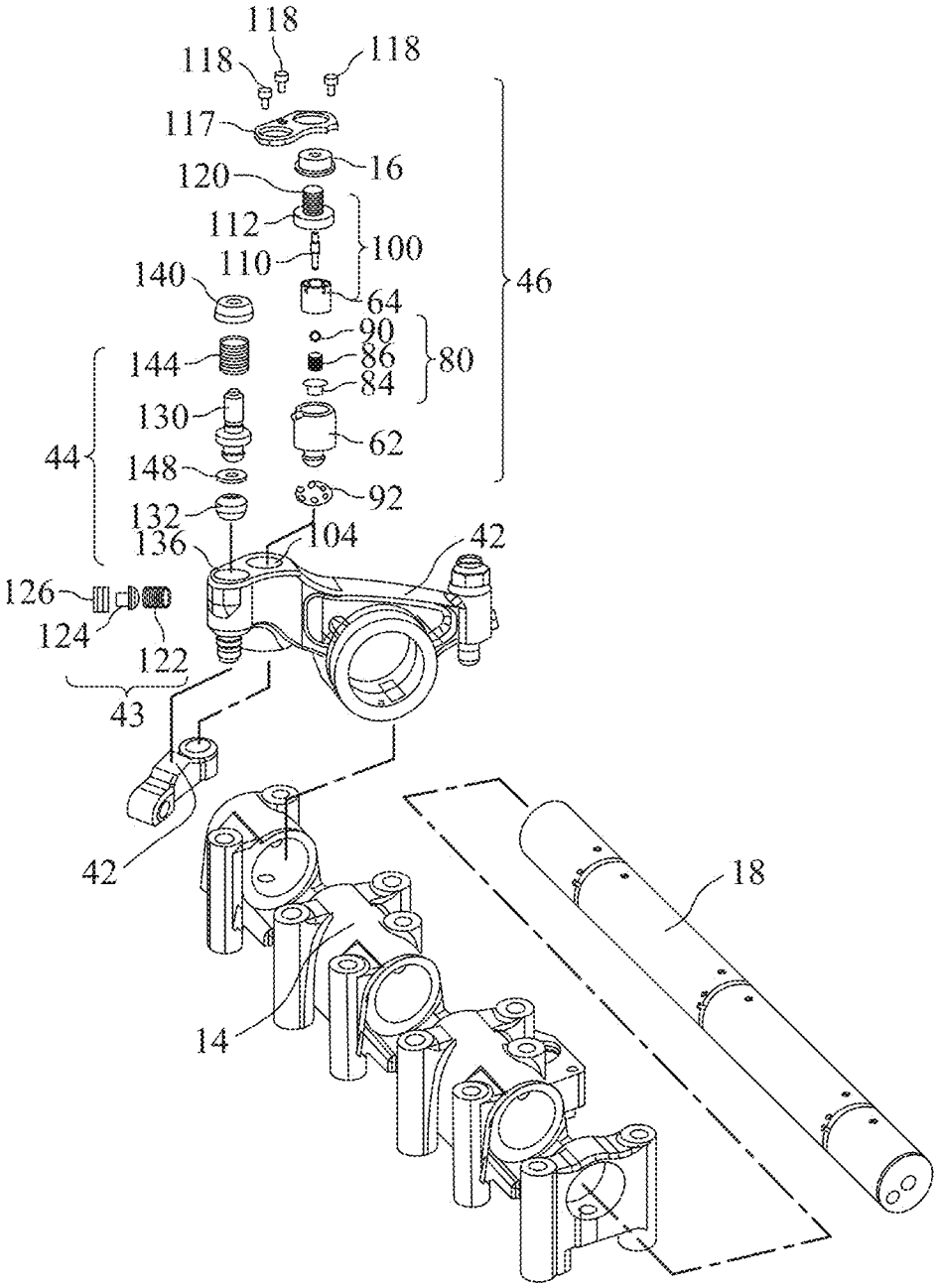
FIG. 2 illustrates an exploded schematic view of an exhaust rocker arm assembly of the valvetrain assembly, according to particular embodiments.
Figure 3A:
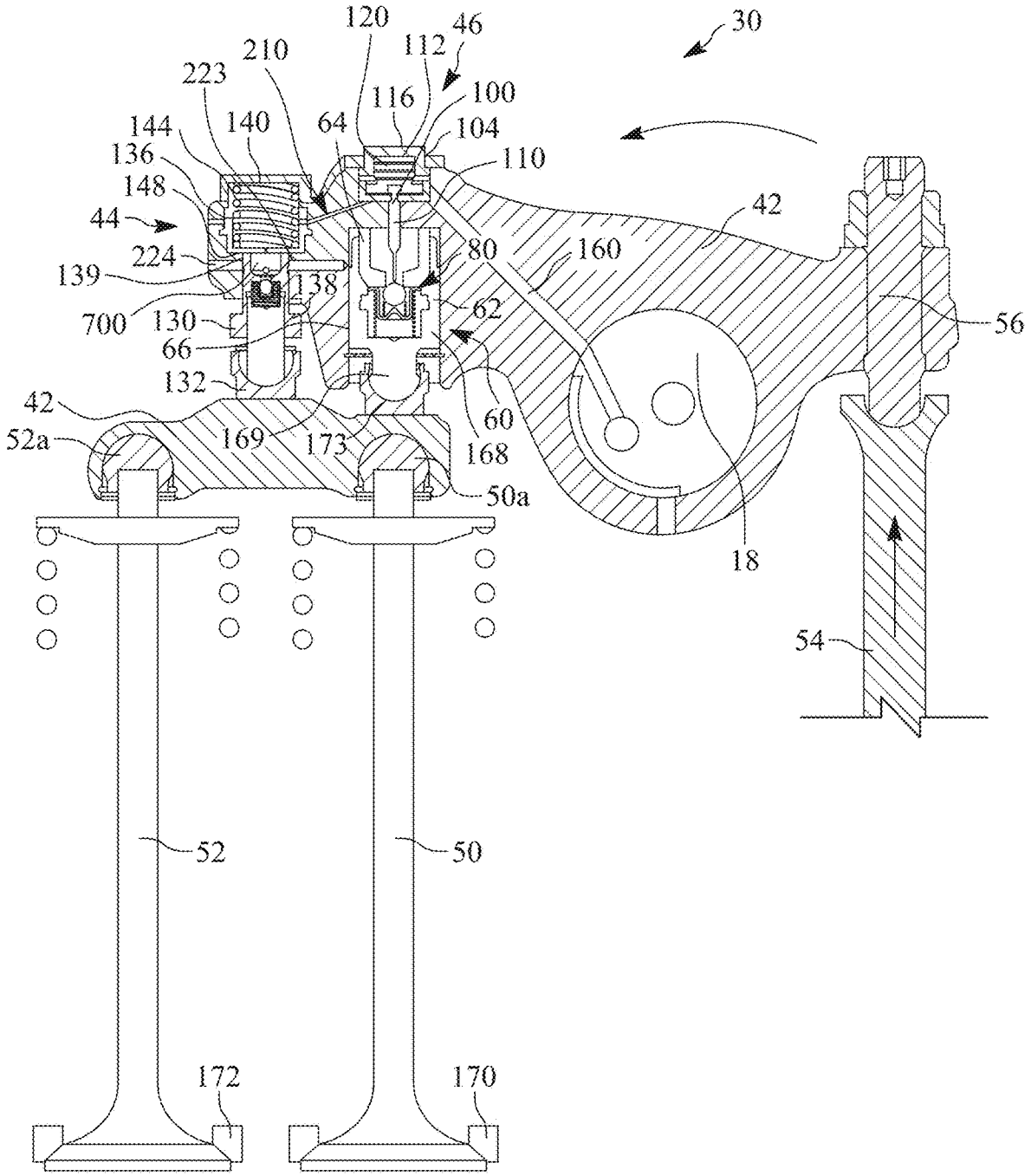
FIG. 3A illustrates a schematic sectional illustration of an exhaust rocker arm assembly of the valvetrain assembly, illustrated in a non-engine braking mode, according to particular embodiments.

With further reference now to FIGS. 2 and 3A, an exhaust rocker arm assembly 30 will be further described. In particular embodiments, the exhaust rocker arm assembly 30 may generally include a rocker arm 11, a valve bridge 42, a lost motion mechanism 44, and/or a brake capsule 46. Valve bridge 42 may engage a first and a second exhaust valve 50 and 52, respectively (FIG. 3A) associated with a cylinder of an engine (not shown). The first and second exhaust valves 50 and 52 may have corresponding elephant feet, or E-feet, 50*a* and 52*a*, respectively. The E-feet 50*a* and 52*a* may allow the valve bridge 42 to move without creating any side load on the corresponding valve stems 50 and 52, respectively. One or both E-feet may be spherical or cylindrical. A pushrod 54 (e.g., FIG. 3A) may move upward or downward based on a lift profile received from a cam of a camshaft (not shown). Upward movement of the pushrod 54 may push an arm 56 fixed to the rocker arm 11, and in turn may cause rocker arm 11 to rotate counterclockwise around the rocker shaft 18. In particular embodiments, rocker arm 11 may be directly or otherwise acted upon by a cam of a camshaft, rather than through a pushrod, such as pushrod 54.

In particular embodiments, brake capsule 46 may be longitudinally aligned (as seen in at least FIG. 3A) with an exhaust valve 50, which may also be designated as brake valve 50. In particular embodiments, lost motion mechanism 44 may be longitudinally aligned (as seen in at least FIG. 3A) with or near the center of valve bridge 42, so as to be capable of influencing and/or exerting opening force on both exhaust valves 50 and 52, when intended.

In particular embodiments, valve bridge 42 may be in contact with a pin or socket traversing through a hole or passage, the pin or socket (such as first socket 173) receiving valve lift from brake capsule 46, valve bridge 42 making contact with a first exhaust valve 50, also called brake valve 50. In particular embodiments, valve bridge 42 may separately or additionally receive valve lift from lost motion mechanism 44, and valve bridge 42 may be in contact with a second exhaust valve 52.

Figure 4:
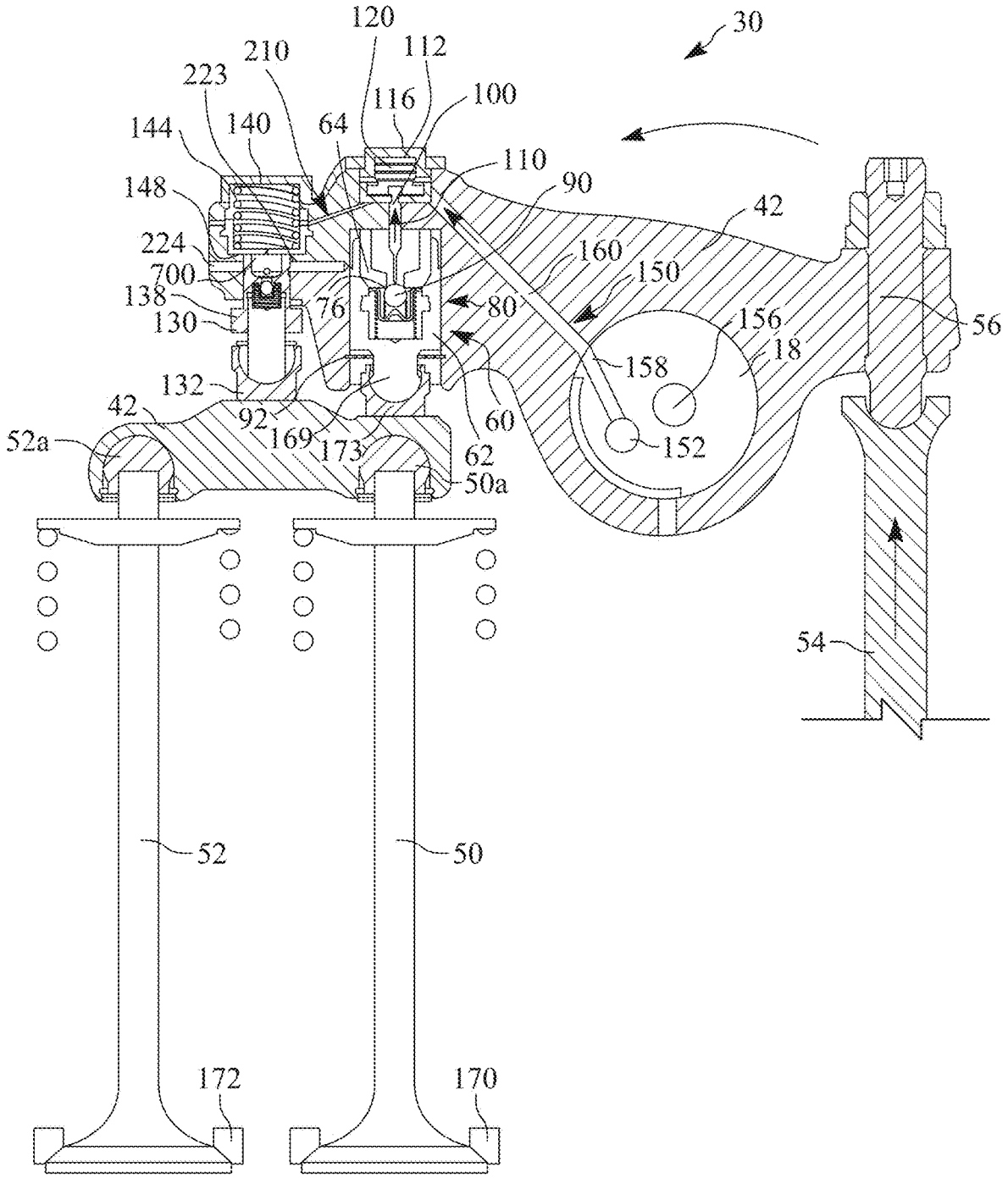
FIG. 4 illustrates a schematic sectional illustration of an exhaust rocker arm assembly, illustrated in an engine braking mode, according to particular embodiments.

By way of example and not limitation, brake capsule 46 may be hydraulically controlled and/or actuated, in particular embodiments. The brake capsule 46 may comprise a plunger assembly 60 including a first plunger body 62 and a second plunger body 64. The second plunger body 64 may be partially received by the first plunger body 62. The plunger assembly 60 may be received by a first bore 66 defined in the rocker arm 11. The first plunger body 64 may have a first closed end 168 that defines a first spigot 169, which may be received in a first socket 173 that may act against the valve bridge 42. The second plunger body 64 may have an opening that may define a valve seat 76 (FIG. 4). A check ball assembly 80 may be positioned between the first and second plunger bodies 62 and 64, respectively. The check ball assembly 80 may include a first biasing member 82, a cage 84, a second biasing member 86, and/or a check ball 90. A snap ring 92 may nest in a radial groove provided in the first bore 66 of the rocker arm 11. The snap ring 92 may retain the first plunger body in the first bore 66.

An actuator or needle 100 may be received in a second bore 104 of the rocker arm 11. The needle 100 may act as an actuator that selectively releases pressure in the brake capsule 46. The needle 100 may include a longitudinal pin portion 110 and an upper disk portion 112. A first cap 116 may be fixed to the rocker arm 11 with a plate 117 and/or a plurality of fasteners 118 at the second bore 104, and may capture a biasing member 120 therein. The biasing member 120 may act between the first cap 116 and the upper disk portion 112 of the needle 100. In the non-limiting example shown, the biasing member 120 may bias the needle 100 downward, as illustrated in at least FIGS. 3A-3B. As a non-limiting example, biasing member 120 may comprise a spring.

In particular embodiments, pressurized hydraulic fluid, such as oil, may be selectively supplied to upper disk portion 112 via a hydraulic supply passage 160. As a non-limiting example, based on receiving one or more control signals, an oil control valve (OCV) may be used to permit or prevent flow of pressurized hydraulic fluid in hydraulic supply passage 160. Additional aspects of supply and/or control of pressurized hydraulic fluid and/or control fluid have been further detailed in other sections herein. In particular embodiments, when hydraulic supply passage 160 has a low pressure level and/or may not supplied with pressurized oil, upper disk portion 112 of actuator or needle 100 may be biased downward by biasing member 120, holding check ball 90 open and permitting oil flow around and past valve seat 76. Consequently, this may cause brake capsule 46 to become "soft," i.e., enter a collapsible state and become incapable of influencing or exerting an opening force upon the valve bridge 42.

In particular embodiments, when hydraulic supply passage 160 has a high pressure level and/or is supplied with suitably pressurized oil, upper disk portion 112 of actuator or needle 100 may be lifted up against the bias of biasing member 120. As a result, longitudinal pin portion 110 may move away from check ball 90, closing the check ball 90 against valve seat 76. Consequently, brake capsule 46 may act as a no-return valve, with the first plunger body 62 extending toward valve bridge 42, with a rigid structure relative to a valve opening force to be exerted upon valve bridge 42.

As a result, in particular embodiments, brake capsule 46 may provide a switchable system for selectively enabling or disabling the ability of first plunger body 62 to influence or exert an opening force on valve bridge 42 and/or exhaust valve 50 (also called brake valve 50). Although this disclosure describes providing particular means of actuation and/or control of a brake capsule, this disclosure contemplates providing any suitable means of actuation and/or control of one or more capsules, such as brake capsules, in any suitable manner. As a non-limiting example, In particular embodiments, brake capsule 46 may be electrically actuated and/or controlled.

Figure 3B:
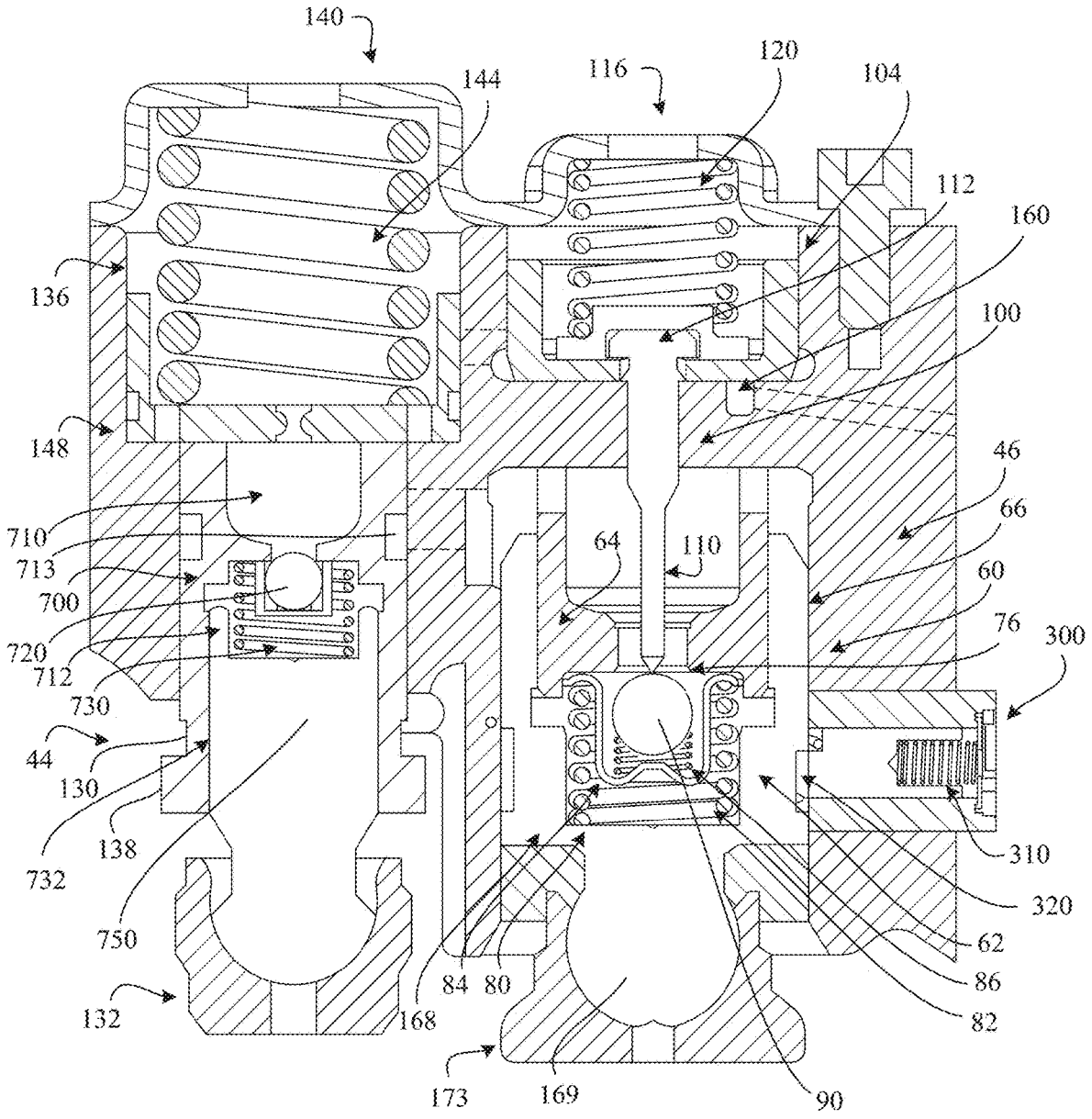
FIG. 3B illustrates a schematic enlarged sectional partial view of an exhaust rocker arm assembly, according to particular embodiments.

As a non-limiting example, in particular operating modes, such as when an engine braking mode is disabled, brake capsule 46 may continue to cyclically extend and compress with engine cycles, which may cause unnecessary flow of hydraulic fluid, such as oil. In particular embodiments, a capsule locking mechanism 300 (for example, as illustrated in FIG. 3B) may be optionally provided to reduce redundant flow and/or consumption of hydraulic fluid and/or control fluid, such as oil. In particular embodiments, capsule locking mechanism 300 may comprise a capsule locking pin 310 that may be selectively extensible to engage with a suitable feature of brake capsule 46, such as groove 320 of first plunger body 62, to constrain the first plunger body 62 in a collapsed or retracted position.

As non-limiting examples, capsule locking pin 310 may be selectively extended using a hydraulic actuator, or using an electric actuator. By way of illustration and not limitation, a hydraulic actuator may comprise an oil pressure control mechanism to control oil pressure to a piston or plunger, optionally combined with one or more biasing elements, such as springs. By way of illustration and not limitation, an electric actuator may comprise an electric motor controllable by an external signal based on requirement. While a capsule locking mechanism 300 may be illustrated in a subset of figures, such as FIG. 3B, capsule locking mechanism 300 is contemplated with any or all other embodiments disclosed herein.

In particular embodiments, a lost motion mechanism 44 may be incorporated into a rocker arm assembly 3. The lost motion mechanism 44 may generally include a lost motion shaft 130 having a distal end that is received by a second socket 132, and a proximal end that may extend into a third bore 136 defined in the rocker arm 11. A collar 138 may extend from an intermediate portion of the lost motion shaft 130. The lost motion shaft 130 may extend through a passage 139 formed through the rocker arm 11. A second cap 140 may be fixed to the rocker arm 11 at the third bore 136, and may capture a biasing member 144 therein. The biasing member 144 may act between the second cap 140 and a snap ring 148 fixed to the proximal end of the lost motion shaft 130. As will be described, the lost motion shaft 130 may remain in contact with the rocker arm 11, and may be permitted to translate along its axis within the passage 139.

Traditional decompression engine braking systems may be incompatible with automatic lash adjustment systems. In particular cases, a main rocker separating from the bridge when engine braking is activated may separately or additionally add to the challenge of incorporating automatic lash adjustment, as the separation may cause unintended pumping up or extension of a lash adjustment system, such as a hydraulic lash adjuster.

Among other features and benefits disclosed herein, this disclosure provides methodologies and devices that enable the use of hydraulic lash adjuster 700 integrated in a lost motion mechanism 44 to overcome these challenges. In particular embodiments, a lost motion mechanism 44 may suitably keep a valve bridge under load during the brake lift periods when engine braking is activated.

As discussed and motivated above, in particular embodiments, a hydraulic lash adjuster 700, also referred to as HLA 700 herein, may be optionally incorporated into lost motion mechanism 44. Hydraulic lash adjuster 700 may provide compensation for lash (not shown) between the lost motion shaft 130 and the valve bridge 42. In particular embodiments, HLA 700 integrated into lost motion mechanism 44 may provide lash compensation for both non-braking exhaust valve operation as well as engine braking valve operation. As a non-limiting example, hydraulic lash adjuster 700 may be capable of expanding to close and/or eliminate mechanical lash. Separately or additionally, hydraulic lash adjuster 700 may be capable of collapsing as needed, to ensure that one or more engine valves that may be intended to fully close are permitted to do so as and when intended, by design. One or more engine valves unintentionally not fully closing may affect engine performance, sometimes severely so. As a non-limiting example, it may be desired for hydraulic lash adjuster 700 to partially collapse based on thermal expansion of the components of rocker arm assembly 3 and/or other aspects of the valvetrain.

As illustrated with additional detail in at least FIG. 3B, according to particular embodiments, a hydraulic lash adjuster 700, or HLA 700, may comprise an upper HLA chamber 710 and a lower HLA chamber 712. Pressurized oil may be supplied to hydraulic lash adjuster 700 by one or more hydraulic lines provided (may not be shown) in the rocker arm assembly 3. By way of example and not limitation, a continuous supply of pressurized oil may be provided by an engine oil pump (not shown) and/or the engine's hydraulic fluid supply. In particular embodiments, an HLA refilling channel 223 may be used to refill the HLA with oil drawn from the engine oil pump.

In particular embodiments, upper HLA chamber 710 may function as a pressurized hydraulic fluid reservoir. As a non-limiting example, pressurized hydraulic fluid may enter upper HLA chamber 710 through a first aperture 713. A one-way valve, such as HLA check ball 720, may selectively restrict or permit hydraulic fluid flow between upper HLA chamber 710 and lower HLA chamber 712. Forces may be transferred between exhaust valves 50, 52, and rocker arm 11 through the valve bridge 42, plunger 750, and the oil in lower HLA chamber 712. In particular embodiments, one or more HLA biasing elements 730 may be provided. As a non-limiting example, an HLA biasing element 730 may be a spring.

In operation, hydraulic fluid (such as oil) may flow into lower HLA chamber 712 via a one-way valve, such as HLA check ball 720, but may escape lower HLA chamber 712 only slowly via one or more precise and very small leak surfaces, gates, or channels. Accordingly, HLA 700 may extend to accommodate slack or lash in rocker arm assembly 3 during part of the engine cycle, such that HLA check ball 720 may open, allowing the lower HLA chamber 712 of the expanding hydraulic lash adjuster 700 to pull in oil from upper HLA chamber 710. Subsequently, after HLA 700 is extended to overcome any lash, check ball 720 may close based on the increasing transferred forces from an exhaust valve, such as 50 and/or 52, substantially trapping the relatively incompressible hydraulic fluid in the lower HLA chamber 712, providing rigid, or nearly rigid, support for the rocker arm assembly 3. In other words, the hydraulic fluid may prevent the plunger 750 being pushed inward, so that HLA 700 may act as a solid body or nearly solid body for force transfer.

As mentioned herein, in particular embodiments, a small quantity of oil may flow or leak out of the hydraulic lash adjuster 700, by design. By way of example and not limitation, a precisely controlled radial gate may be provided for releasing a small, metered quantity of leakage oil, such as during every engine cycle involving opening and closing of engine valves. In particular embodiments, such low leakage flows of oil out of the hydraulic lash adjuster 700 may occur through and past an interface at the outer diameter of plunger 750, such as interface 732. As a non-limiting example, the hydraulic fluid escaping through leak surfaces, gates, or channels may flow back into upper HLA chamber 710.

In particular embodiments, HLA 700 may extend only after lost motion shaft 130 has completed its extension. Extension of HLA 700 may compensate for a mechanical lash increase in the system and ensure that all components may be in contact prior to the next valve lift event. In particular embodiments, HLA 700 may collapse by a small amount during valve lift events due to oil leakage, which may be driven by high oil pressures when HLA 700 may be under load. As mentioned, HLA 700 may only collapse in a very controlled manner under load, based on the precise, small dimensions and geometry of leakage paths designed and implemented. As a non-limiting example, the dimensions of the outer diameter of plunger 750 relative to the inner diameter of lost motion shaft 130 may provide part or the whole of the metering required to control the leakage and/or collapse rate of HLA 700.

With reference now to FIGS. 4, and 11-13, particular embodiments of an oil circuit 150 of the rocker arm assembly 3 will now be described. While one or more particular embodiments of oil circuit 150 may be disclosed particularly herein as non-limiting examples, it will be appreciated that a variety of configurations and/or feature combinations for oil circuit 150 may be used to accomplish the operational goals of the disclosed embodiments. Additionally, all disclosed aspects of one or more oil circuits may not be visible in each or all view(s), based on physical reality in a visualized plane, and/or omission for clarity of disclosing particular features. In particular embodiments, the rocker shaft 18 may define a central pressurized oil supply conduit 152, a vent oil passage or conduit 154, a lubrication conduit 156, and/or a capsule oil conduit 180. The vent oil conduit 154 may have a vent lobe 157 extending generally parallel to an axis of the rocker shaft 18 and transverse to the vent oil conduit 154. A connecting passage 158 (e.g., FIG. 11) may connect the central pressurized oil supply conduit 152 with an oil supply passage 160 defined in the rocker arm 11. The capsule oil conduit 180 may be used to supply oil to the brake capsule 46.

In particular embodiments, an auxiliary reset channel 210 may provide hydraulic fluid and/or control fluid connection, such as for oil, between brake capsule 46 and the third bore 136 of lost motion mechanism 44. In particular embodiments, HLA 700 of lost motion mechanism 44 may receive hydraulic fluid and/or control fluid through HLA refilling channel 223.

As discussed herein, in particular embodiments, the pressurized oil supply conduit 152, the connecting passage 158, and/or the oil supply passage 160 may cooperate to selectively supply pressurized oil to the second bore 104 to urge the upper disk portion 112 of the needle 100 upward. As the rocker arm 11 rotates around the rocker shaft 18, the vent lobe 157 may align with the oil supply passage 160, causing oil to be vented away from the second bore 104 through the vent oil conduit 154. As described herein, oil may also be drained through the auxiliary reset channel 210. When the pressure drops in the second bore 104, the second spring 120 may urge the needle 100 downward such that the longitudinal pin 110 may act against the ball 90 and move the ball away from the valve seat 76. Oil may then be permitted to flow through the valve seat 76 and out of the brake capsule 46, such as through HLA refilling channel 223, and/or a pressure relief valve assembly 43.

Figure 5:
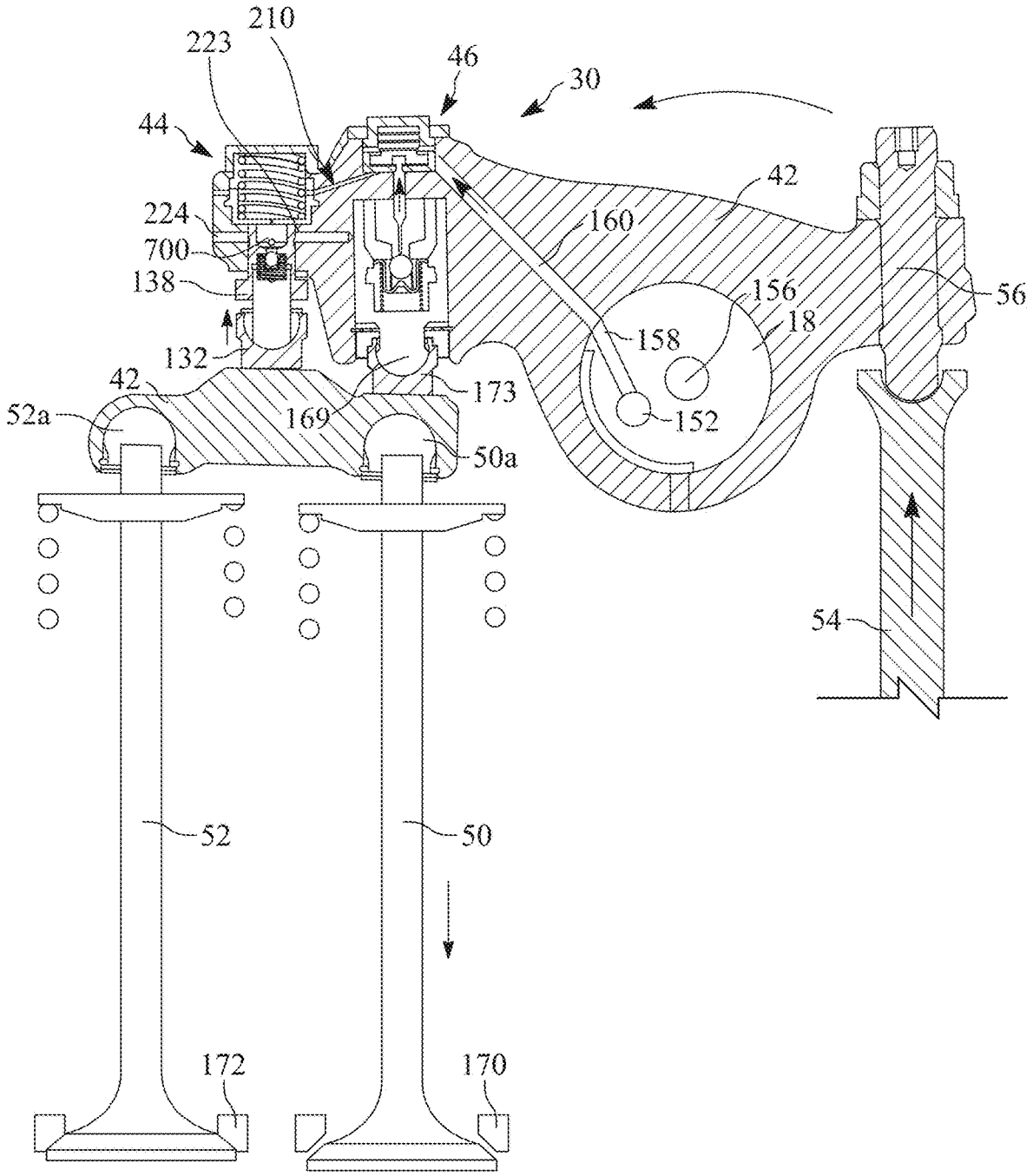
FIG. 5 illustrates a schematic sectional illustration of an exhaust rocker arm assembly, illustrated in engine braking mode with initial rotation of the rocker arm in the counterclockwise direction and a first exhaust valve beginning to open, according to particular embodiments.
Figure 6:
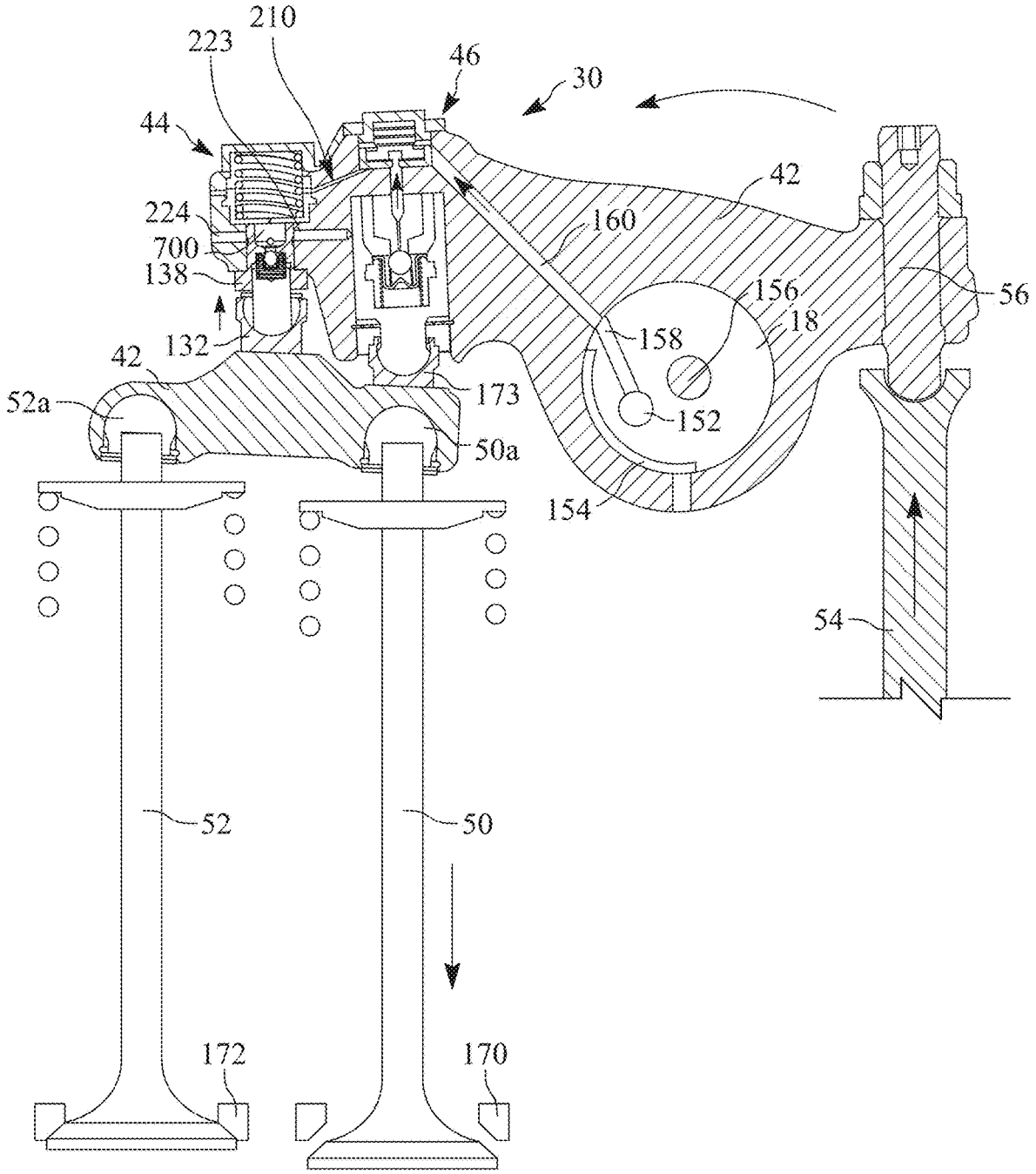
FIG. 6 illustrates a schematic sectional illustration of an exhaust rocker arm assembly, illustrated in engine braking mode with further rotation of the rocker arm in the counterclockwise direction and with the first exhaust valve further opening, according to particular embodiments.

As will become appreciated herein, in particular embodiments, the exhaust rocker arm assembly 30 may operate in a default combustion engine mode and/or with engine braking off or disabled (FIG. 3A) and an engine braking mode enabled mode (e.g., FIGS. 4-6). When the exhaust rocker arm assembly 30 is operating in the default combustion engine mode and/or with engine braking disabled (e.g., FIG. 3A), an oil control valve 152 may be closed, i.e., not energized. As a result, in particular embodiments, the oil supply passage 160 defined in the rocker arm 11 may have a low pressure level. Other oil pressures may be used. With low pressure, the biasing member 120 may force the needle 100 in a downward direction, causing the longitudinal pin portion 110 to urge the ball 90 away from the valve seat 76. The check ball assembly 80 may therefore open, causing the brake capsule 46 to become "soft" or enter a collapsible state, and thereby becoming unable to influence a downward force upon the valve bridge 42. In the default combustion engine mode and/or with engine braking disabled (e.g., FIG. 3A), continued rotation of the rocker arm 11 in the counterclockwise direction may cause the collar 138 on the lost motion shaft 130 to engage the rocker arm 11, limiting its traverse thereafter. Further continued rotation of the rocker arm 11 may cause both the first and the second valves 50 and 52 to open together, and subsequently, to close together, following the valve lift profile received by rocker arm 11, directly or indirectly, from a cam of a camshaft.

Figure 4A:
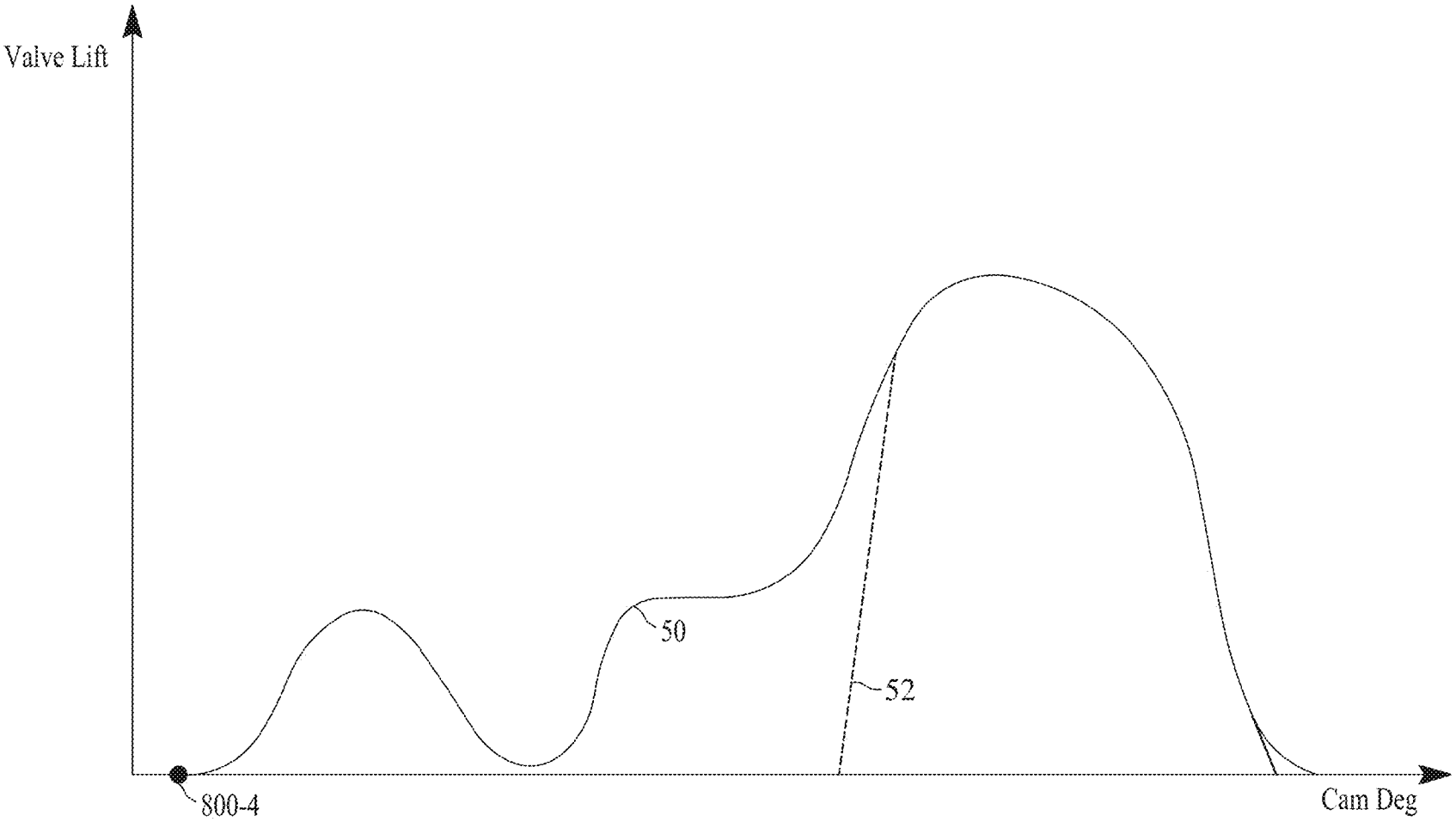
FIG. 4A illustrates a schematic plot of cam angle versus valve lift for an exhaust rocker arm assembly of the present teachings, identifying the position of FIG. 4 on the base circle, according to particular embodiments.

With reference now to FIG. 4, operation of the exhaust rocker arm assembly 30 in the engine braking mode will be described, according to particular embodiments. In braking mode, oil pressure may be increased in oil supply passage 160, causing the needle 100 to move upward against the bias of the biasing member 120. As a result, the longitudinal pin portion 110 may be moved away from the check ball 90, which is then seated against valve seat 76, sealing off the intermediate oil passage. The brake capsule 46 may therefore act as a no-return valve, with the first plunger body 62 rigidly extending toward the valve bridge 42. FIG. 4A is a schematic plot of cam angle versus valve lift for an exhaust rocker arm assembly of the present teachings and identifying the position of FIG. 4 on the base circle as 800-4.

In particular embodiments, HLA 700 may be integrated within lost motion mechanism 44 such when rocker arm 11 motion corresponds to a base circle of a cam, i.e., without positive brake lift, lost motion mechanism 44 may reach its maximum extension hard stop, and any remaining mechanical gap may be automatically compensated by HLA 700. In particular embodiments, an interface between valve bridge 42 and lost motion mechanism 44 may be always under load, regardless of whether or not there is positive brake lift applied on rocker arm 11. Correspondingly, during positive brake lift imparted to rocker arm 11, as will be further described herein, HLA 700 extension may be maintained under load, and thus HLA 700 may not pump up or extend.

Turning now to FIG. 5, the rocker arm 11 may have rotated further counterclockwise around the rocker shaft 18. In the non-limiting example shown, the rocker arm 11 may have rotated 2.72 degrees counterclockwise. In particular embodiments, based on the brake capsule 46 being extended and rigid in this scenario, the first spigot 169 may force the first socket 173 against the valve bridge 42, causing the first valve 50 to move off a first valve seat 170. As a non-limiting example, the first valve 50 may move off the first valve seat 170 by a distance of 2.85 mm. It will be appreciated that other distances and angles of rotation of the rocker arm 11 are fully contemplated herein. Notably, the second valve 52 may remain closed against a second valve seat 172 at this angle of rotation of rocker arm 11. The collar 138 on the lost motion shaft 130, while traveling toward the rocker arm 11, may not have yet reached the rocker arm 11.

Figure 5A:
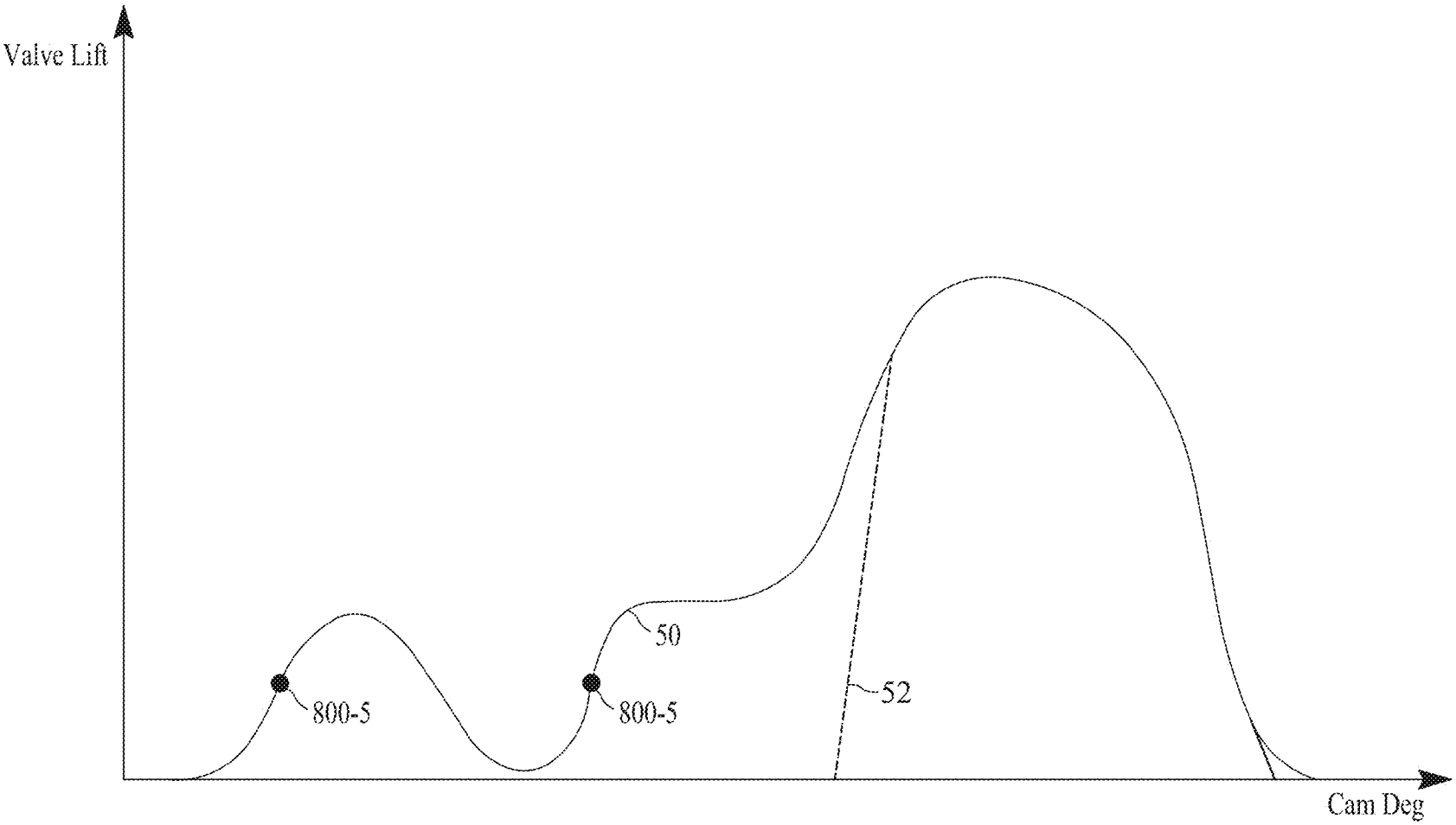
FIG. 5A illustrates a schematic plot of cam angle versus valve lift for an exhaust rocker arm assembly of the present teachings, identifying the position of FIG. 5, according to particular embodiments.

With reference to FIG. 5, as a non-limiting example, the lost motion shaft 130 may have moved about 2 mm of lost motion, and may remain in contact (through the second socket 132) with the rocker arm 11. In particular embodiments, beyond such a representative position or rotation of rocker arm 11, the oil from under the upper disk portion 112 of the needle 100 may flow out, such as through the oil discharge circuit 210. In an embodiment illustrated in FIG. 5 however, the longitudinal pin 110 may not be possible to push down, because the force of the biasing member 120 may be lower than the force generated inside the brake capsule 46 keeping the check ball assembly 80 closed. The oil supply passage 160 may remain in communication with the connecting passage 158. FIG. 5A is a schematic plot of cam angle versus valve lift for an exhaust rocker arm assembly of the present teachings and identifying the position of FIG. 5 with the lost motion shaft as 800-5, as a non-limiting example.

With reference now to FIG. 6, the rocker arm 11 may have rotated further counterclockwise around the rocker shaft 18. In the non-limiting example shown, the rocker arm 11 may have rotated 4.41 degrees. Again, the brake capsule 46 may remain rigid, and the first spigot 169 may continue to force the first socket 173 against the valve bridge 42 causing the first valve 50 to move further off the first valve seat 170. In this non-limiting example, the first valve 50 may have moved off the first valve seat 170 by a distance of 4.09 mm. It will be appreciated that other distances (and angles of rotation of the rocker arm 11) are contemplated. At this point the collar 138 may have made contact with the rocker arm 11 (i.e., lost motion has "bottomed"), and both the first and second valves 50 and 52, respectively, may be opened concurrently.

Figure 6A:
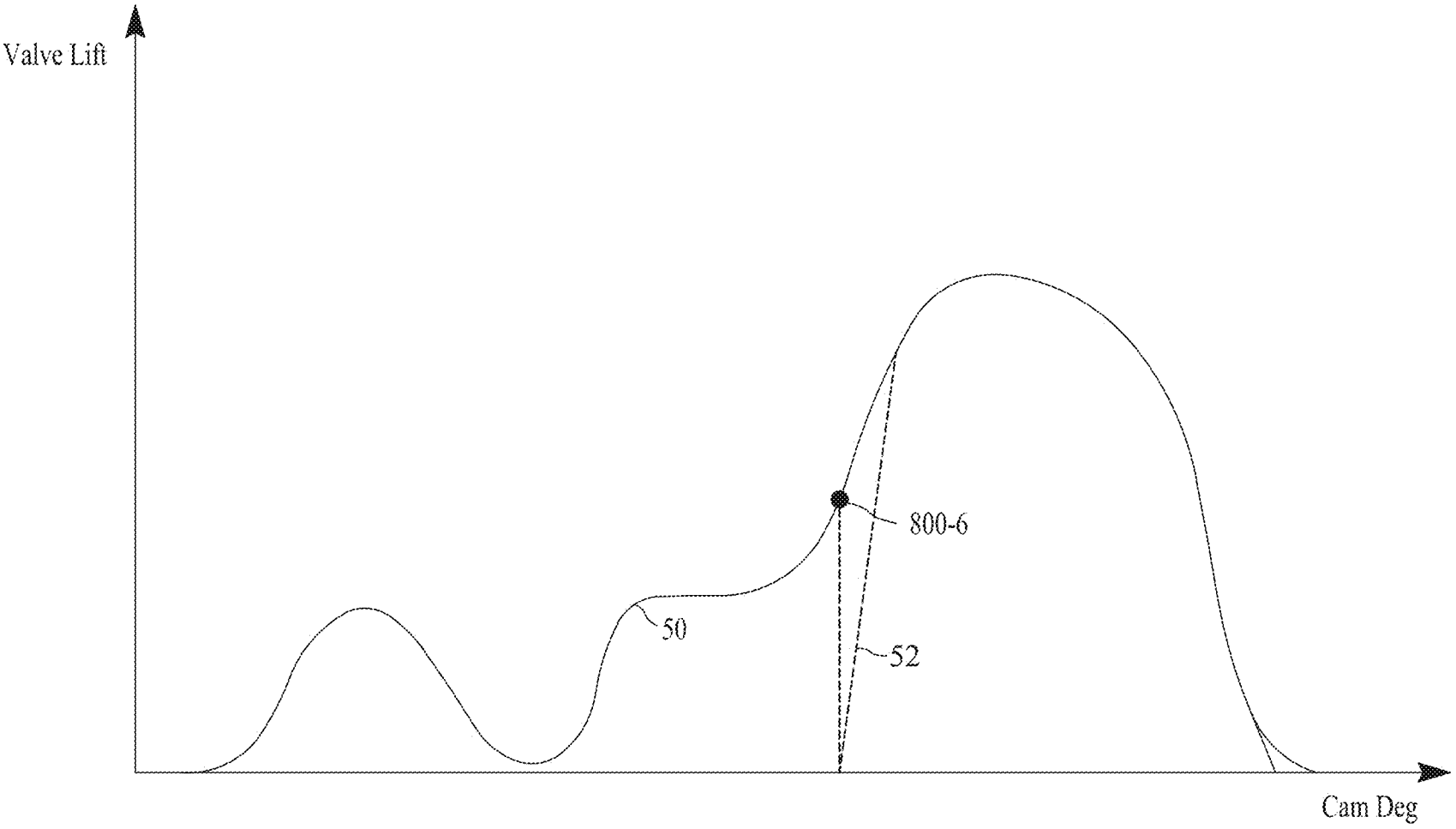
FIG. 6A illustrates a plot of cam angle versus valve lift for an exhaust rocker arm assembly of the present teachings, identifying the position of FIG. 6, according to particular embodiments.

In FIG. 6 however, the longitudinal pin 110 may not be capable of being pushed down because the force of the biasing member 120 may be lower than the force generated inside the brake capsule 46 keeping the check ball assembly 80 closed. The oil supply passage 160 may remain in communication with the connecting passage 158. FIG. 6A is a schematic plot of cam angle versus valve lift for the exhaust rocker arm assembly of the present teachings, identifying the position of FIG. 6 as 800-6, when the lost motion shaft may have bottomed, according to particular embodiments.

Figure 7:
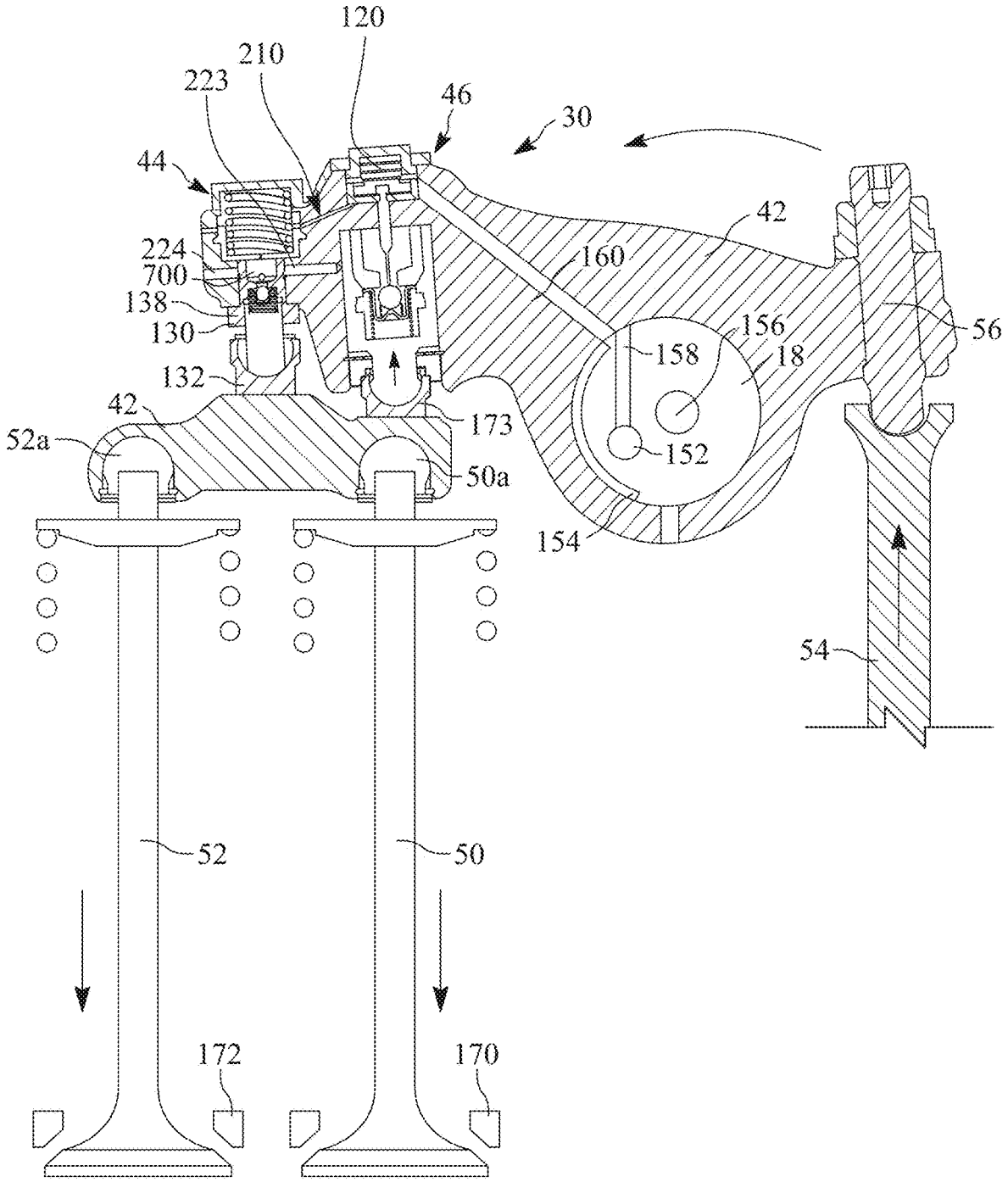
FIG. 7 illustrates a schematic sectional illustration of an exhaust rocker arm assembly, illustrated in engine braking mode with further rotation of the rocker arm in the counterclockwise direction, and illustrated with the first and a second exhaust valves both opened, according to particular embodiments.
Figure 7A:
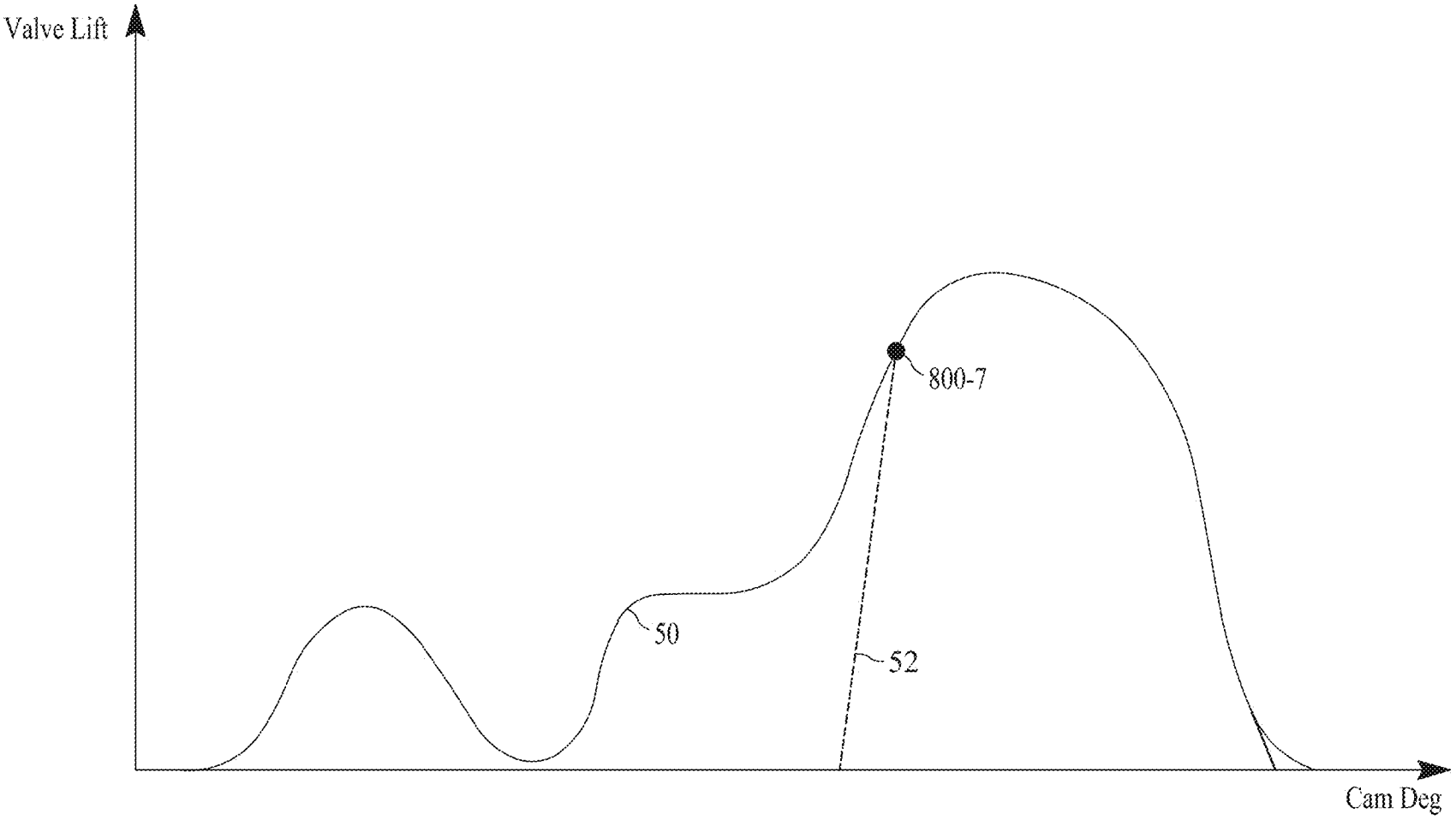
FIG. 7A illustrates a plot of cam angle versus valve lift for an exhaust rocker arm assembly of the present teachings, identifying the position of FIG. 7, according to particular embodiments.

Turning now to FIG. 7, the rocker arm 11 may have rotated further counterclockwise around the rocker shaft 18. In the non-limiting example shown, the rocker arm 11 may have rotated 8.82 degrees. In particular embodiments, the bridge 42 may be in a horizontal position. Again, the brake capsule 46 may remain rigid. The lost motion shaft 130 may urge the bridge 42 downward to open the first and second valves 50 and 52 off their respective valve seats 170 and 172. In this non-limiting example, the first and second valves 50 and 52 are shown to have the same lift, and are shown to have moved off their valve seats 170 and 172 a distance of 9.1 mm. It will be appreciated that other distances (and angles of rotation of the rocker arm 11) are contemplated. The force from the valves 50 and 52 may be fully applied to the second socket 132, and the brake capsule 46 may no longer be under load as the check ball assembly 80 may move to the open position (check ball 90 may have moved off valve seat 76). The oil supply passage 160 may no longer in communication with the connecting passage 158, and therefore the oil from under the upper disk portion 112 of the needle 100 may flow out, allowing the needle 100 to move downward. At this point, the force of the biasing member 120 may be sufficient to open the check ball 90. FIG. 7A is a schematic plot of cam angle versus valve lift for an exhaust rocker arm assembly of the present teachings and identifying the position of FIG. 7 as 800-7, where the bridge may be in a horizontal position.

In particular embodiments, the first and second valves 50 and 52, respectively, may be kinematically constrained to open and close in parallel from the angular position of FIG. 7, and beyond, until both valves have fully closed.

Figure 8:
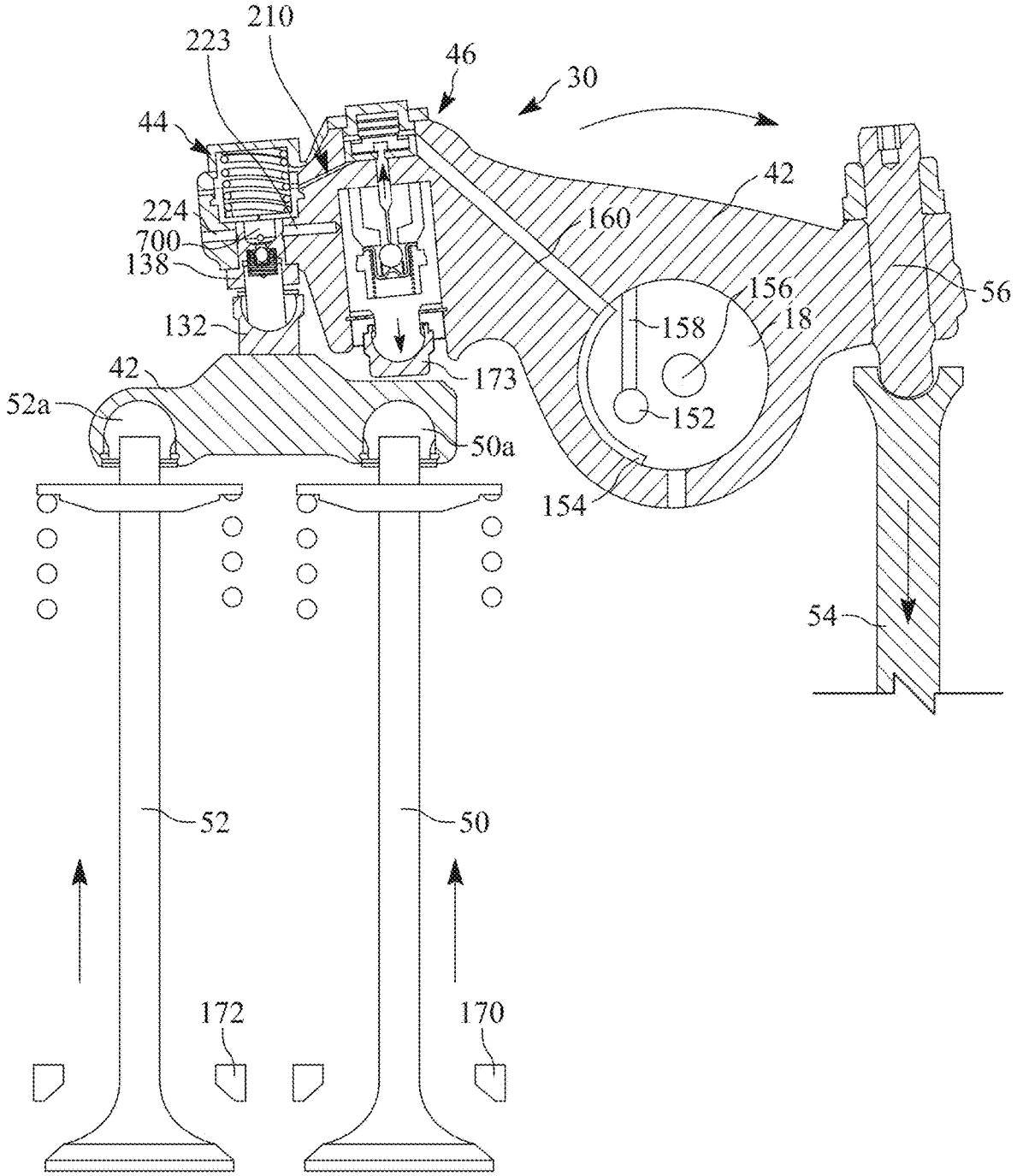
FIG. 8 illustrates a schematic sectional illustration of an exhaust rocker arm assembly of FIG. 7, illustrated in engine braking mode with further rotation of the rocker arm in the counterclockwise direction and with both exhaust valves fully opened, according to particular embodiments.
Figure 8A:
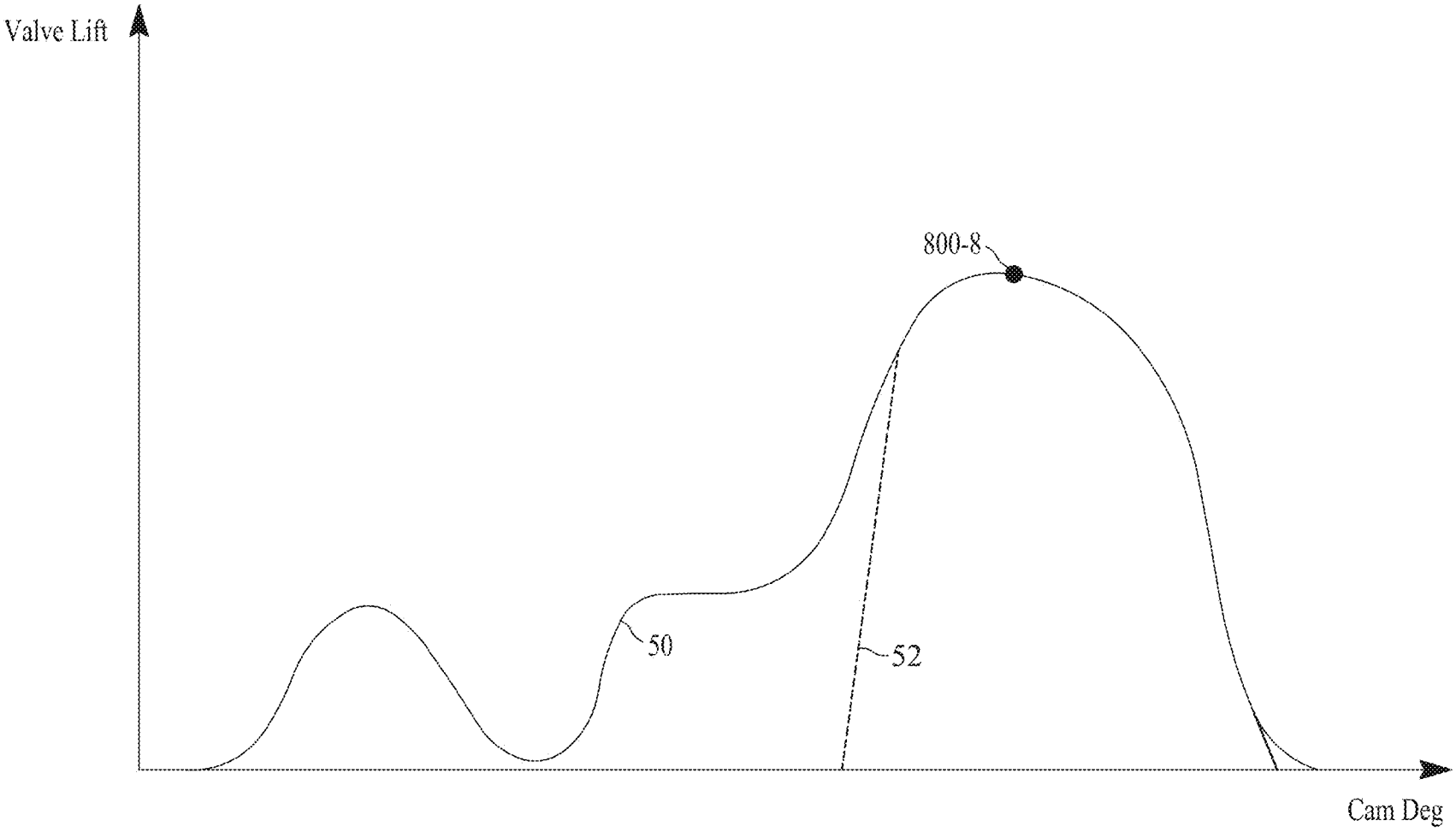
FIG. 8A illustrates a plot of cam angle versus valve lift for an exhaust rocker arm assembly of the present teachings, identifying the position of FIG. 8, according to particular embodiments.

With reference now to FIG. 8, the rocker arm 11 may have rotated further counterclockwise around the rocker shaft 18. In the non-limiting example shown, the rocker arm 11 may have rotated 12.9 degrees. First and second valves 50 and 52, respectively, may be at their maximum lift off their respective valve seats 170 and 172. In the non-limiting example shown, the first and second valves 50 and 52, respectively, may be displaced 15.2 mm off their respective valve seats 170 and 172. As illustrated, the oil supply passage 160 in the rocker arm 11 may be fully disconnected from the connecting passage 158 of the central pressurized oil supply conduit 152. In particular embodiments, oil supply passage 160 may now connected to the vent oil conduit 154 by way of the vent lobe 157. In this position, the supply of pressurized oil may be interrupted, and/or the oil pressure may drop in the oil supply passage 160. As a result, the biasing member 120 may urge the needle 100 downward such that the longitudinal pin portion 110 may push the check ball 90 off the valve seat 76, opening the brake capsule 46. Once the check ball 90 is open, the brake capsule 46 may become "soft" again, and/or may not exercise any force on the first valve 50 during valve closing that could otherwise prevent its closing. The pushrod 54 may now occupy a position consistent with the base circle on the cam (not shown), the above process may continuously repeat until a non-engine braking mode, such as combustion mode, is selected. FIG. 8A is a schematic plot of cam angle versus valve lift for an exhaust rocker arm assembly of the present teachings, identifying the position of FIG. 8 as 800-8, where the valves may be at full lift.

Figure 9:
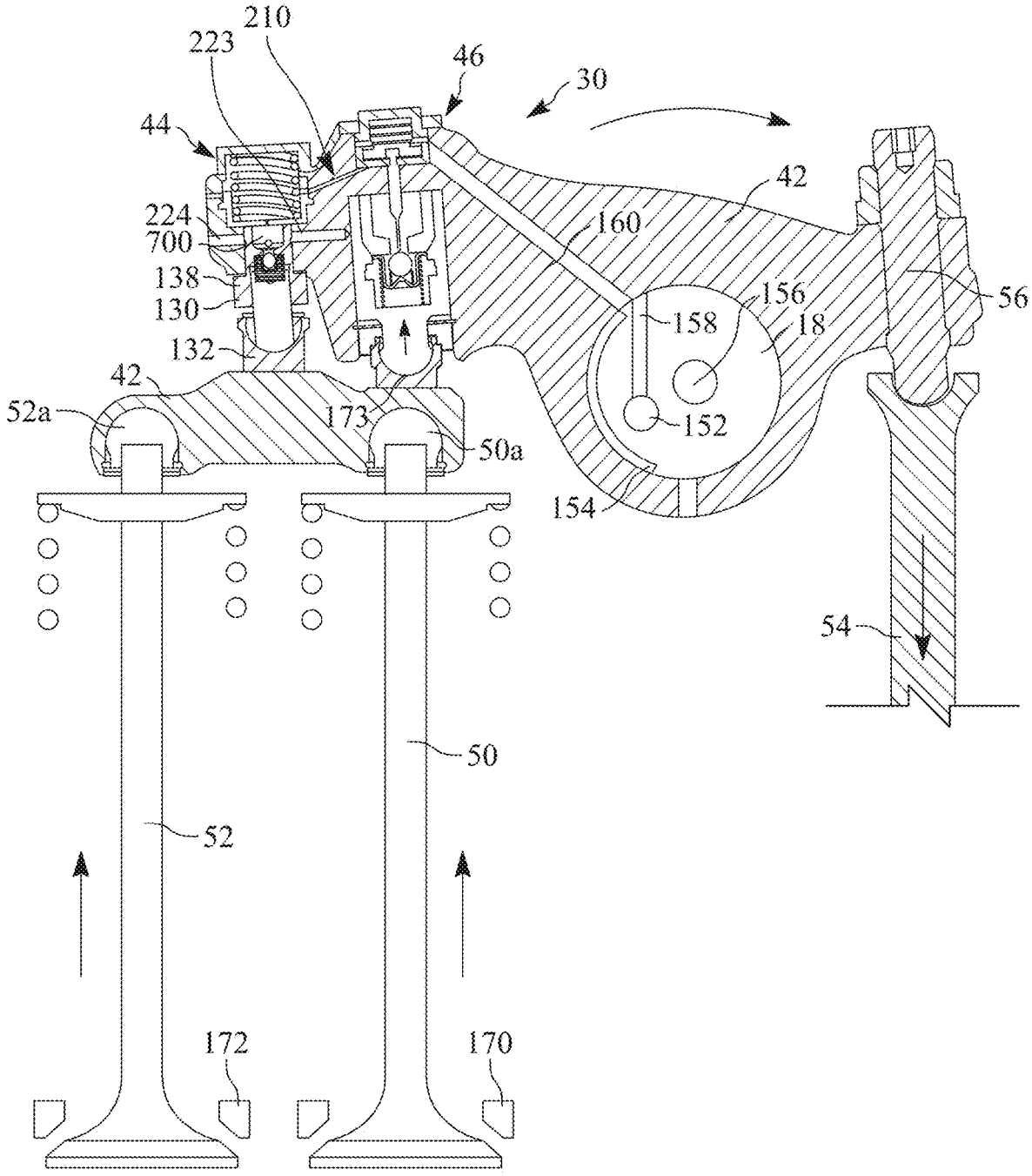
FIG. 9 illustrates a schematic sectional illustration of an exhaust rocker arm assembly of FIG. 8, illustrated during initial valve closure, according to particular embodiments.
Figure 9A:
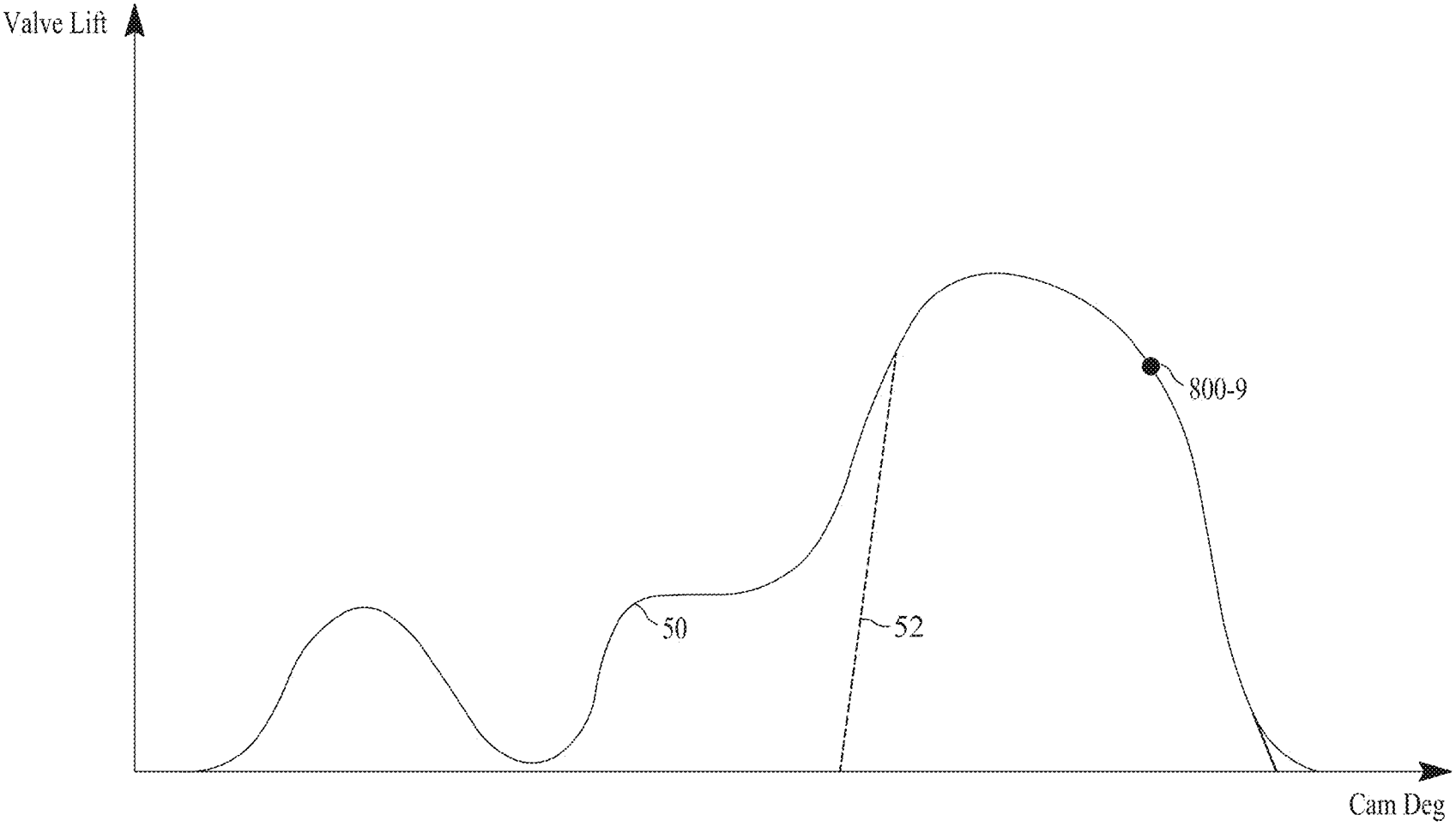
FIG. 9A illustrates a plot of cam angle versus valve lift for an exhaust rocker arm assembly of the present teachings, identifying the position of FIG. 9, according to particular embodiments.

With reference to FIG. 9, the rocker arm 11 may begin to rotate clockwise toward valve closure. When the valves 50 and 52 are closing, the oil supply passage 160 may no longer be in communication with the vent oil conduit 154, but a discharge circuit, such as the discharge oil circuit 210, may remain open, and may allow oil from under the upper disk portion 112 of the needle 100 to continue to discharge if necessary. In particular embodiments, brake capsule 46 may start to be pushed upward by the bridge 42 discharging the oil through a pressure relief valve 43. FIG. 9A is a schematic plot of cam angle versus valve lift for an exhaust rocker arm assembly of the present teachings and identifying the position of FIG. 9 as 800-9, which may be during initial valve closure.

Figure 10:
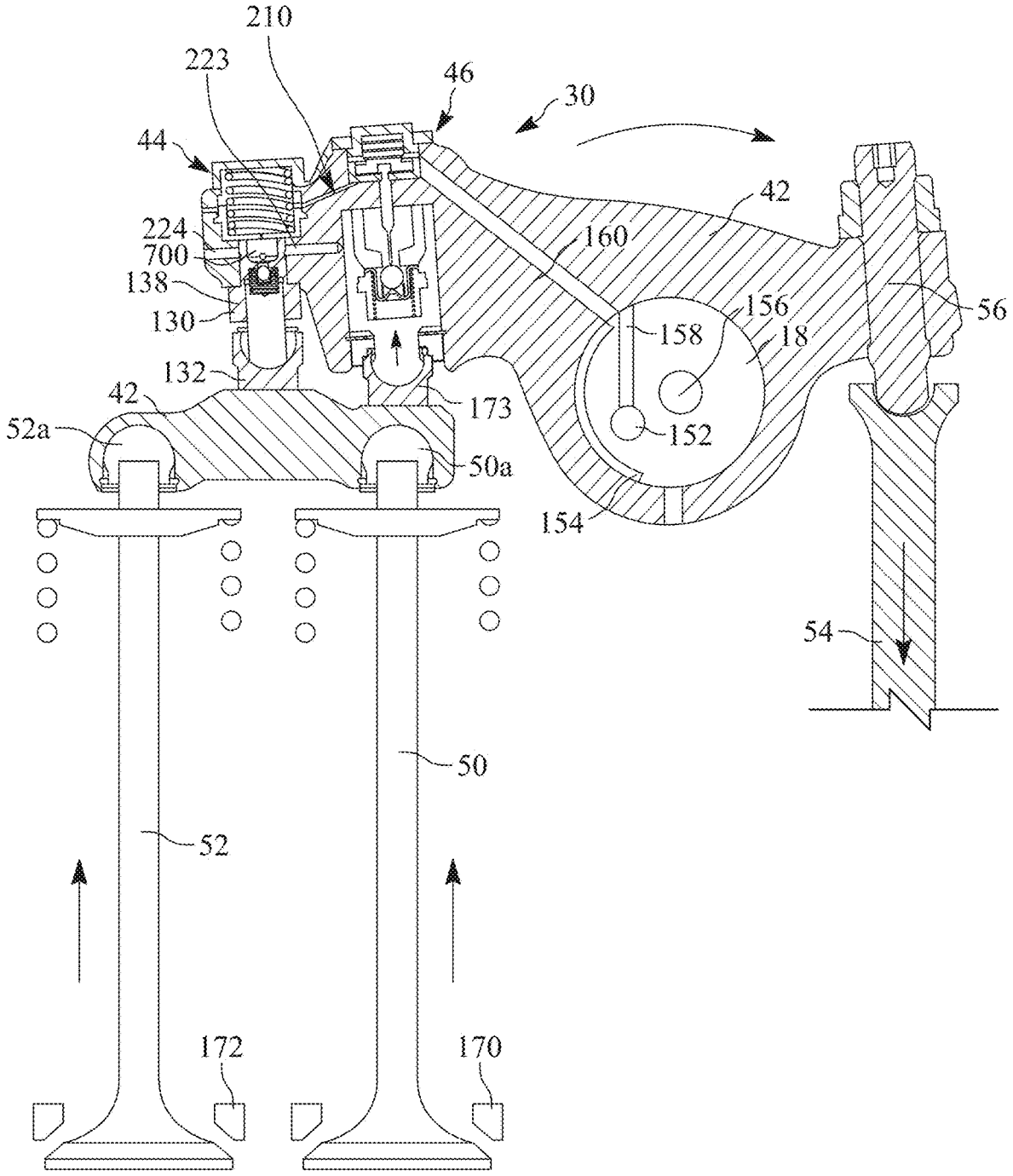
FIG. 10 illustrates a schematic sectional illustration of an exhaust rocker arm assembly of FIG. 9, illustrated during further valve closure, according to particular embodiments.
Figure 10A:
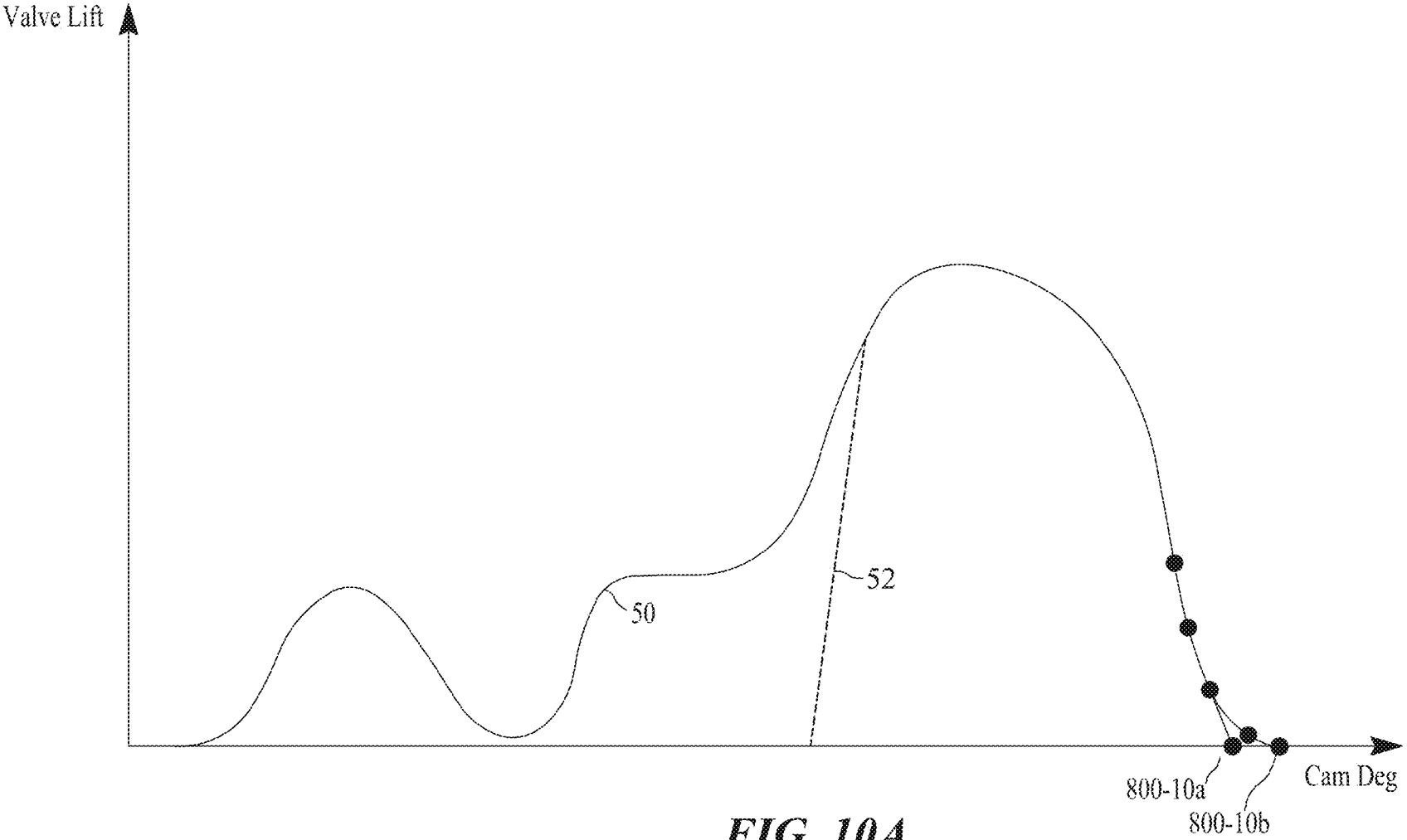
FIG. 10A illustrates a plot of cam angle versus valve lift for an exhaust rocker arm assembly of the present teachings, identifying the position of FIG. 10 during further valve closure, according to particular embodiments.
Figure 11:
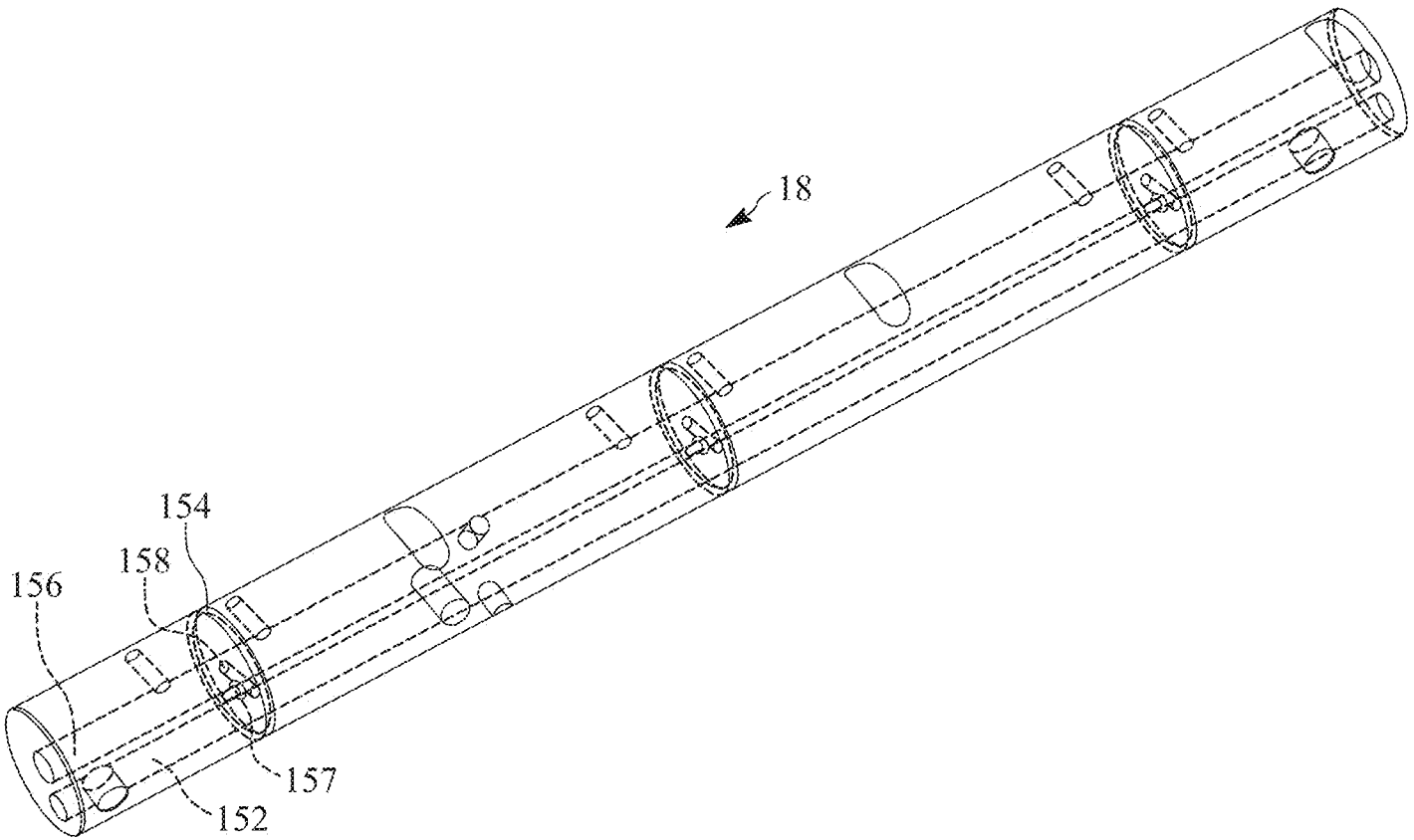
FIG. 11 illustrates a schematic sectional perspective view of a rocker shaft of the rocker arm assembly, according to particular embodiments.
Figure 12:
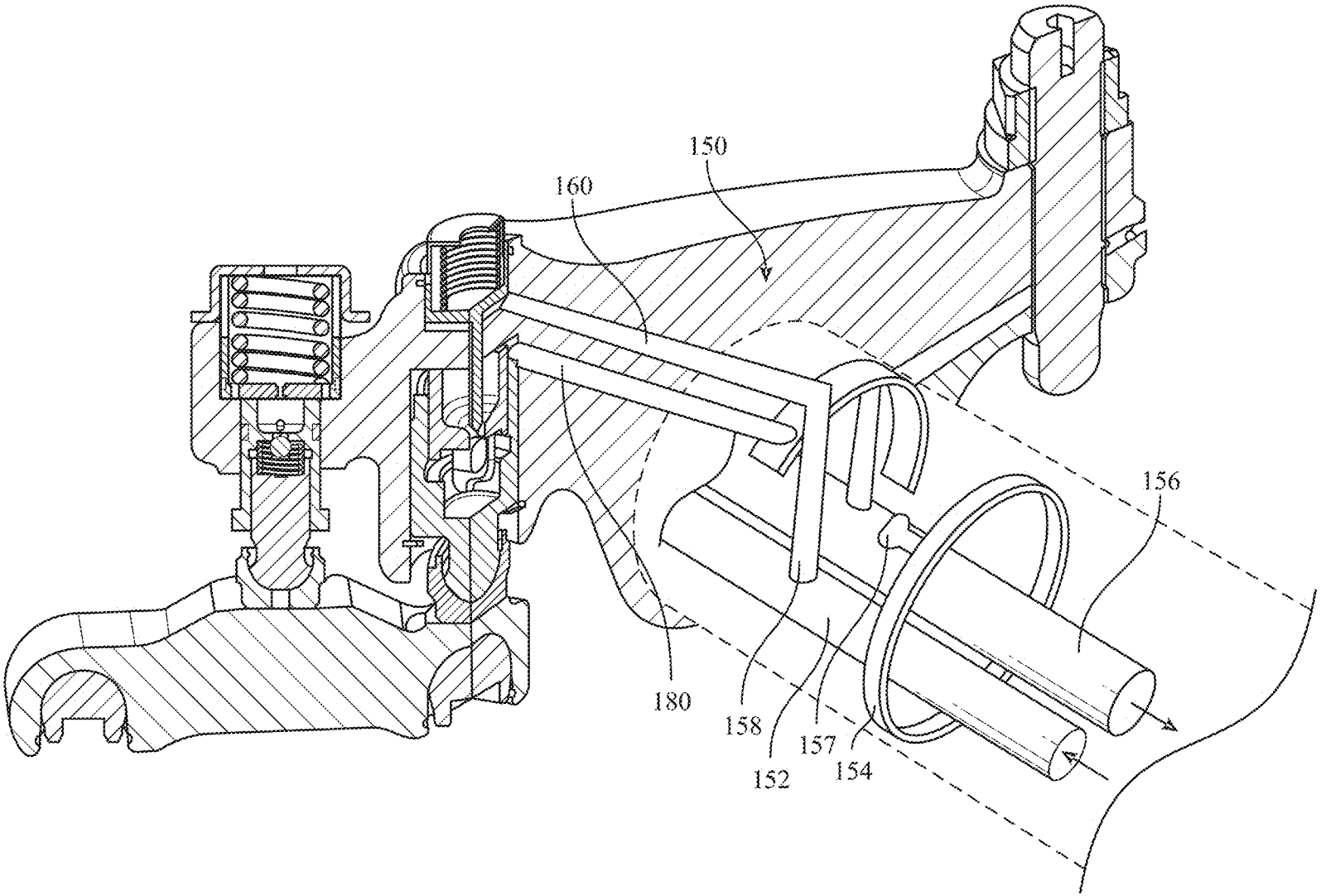
FIG. 12 illustrates a schematic partial sectional perspective view of an oil circuit of an exhaust rocker arm assembly, according to particular embodiments.
Figure 13:
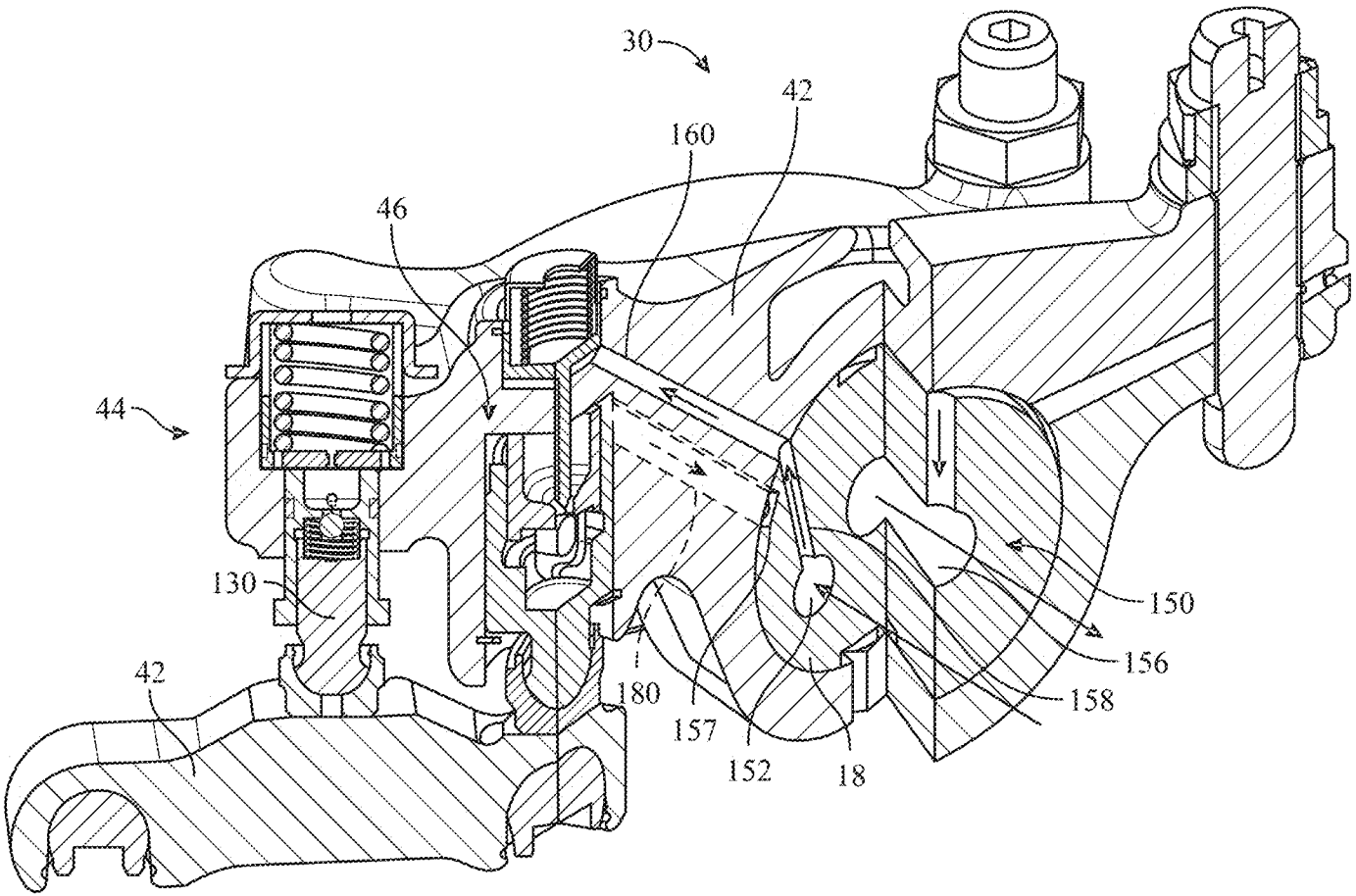
FIG. 13 illustrates a sectional schematic view of an exhaust rocker arm assembly, according to particular embodiments.

Further valve closure may be illustrated. With reference to FIG. 10, valves 50 and 52 may get closer to their respective valve seats 170 and 172, and the oil supply passage 160 may again move into fluid communication with the connecting passage 158. At this point, however, the pressurized oil coming from the connecting passage 158 may not be able to push up the needle 100 immediately because a discharge circuit, such as discharge oil circuit 210, may still be open and/or in communication with ambient. This may guarantee that the check ball assembly 80 may stay opened for an extended time helping the brake capsule 46 to fully discharge. FIG. 10A is a schematic plot of cam angle versus valve lift for the exhaust rocker arm assembly of the present teachings and identifying the multiple position(s) of FIG. 10 during further valve closure.

In particular embodiments lacking a hydraulic lash adjuster such as HLA 700 integrated in lost motion mechanism 44, a mechanical ramp may be required due to mechanical lash that may be inherently present in the absence of automatic lash adjustment, to provided and enable a constant and/or controlled valve closing velocity for valve re-seating. In such embodiments lacking a hydraulic lash adjuster such as HLA 700 integrated in lost motion mechanism 44, as has been disclosed herein, a last incremental distance before closing valves 50, 52 may exhibit a mechanical ramp, schematically illustrated in FIG. 10A by the closing valve lift profile terminating at alternative profile end point 800-10*b* instead of 800-10*a*. As a non-limiting example, embodiments lacking a hydraulic lash adjuster such as HLA 700 integrated in lost motion mechanism 44 may require a relatively long ramp, as the degree or amount of lash that may be present in the system may be variable and/or unknown.

In contrast, in particular embodiments incorporating a hydraulic lash adjuster such as HLA 700 integrated in lost motion mechanism 44, such as disclosed herein, the location and other kinematic quantities of valves 50, 52 is precisely known due to automatic compensation of lash. As a result, a mechanical ramp may not be needed, schematically illustrated in FIG. 10A by the closing valve lift terminating at 800-10*a*.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

Numerical ranges recited in this application should be construed to be inclusive of the end points of the stated ranges. The longitudinal axis of the valve body, which may have been omitted in some illustrations for convenience of scale, should be construed to exist in every illustration where it is referred to.

The invention claimed is:

1. An exhaust valve rocker arm assembly selectively operable in at least an engine braking enabled mode and an engine braking disabled mode, the exhaust valve rocker arm assembly comprising:

a rocker arm configured to rotate about a rocker shaft; and a valve end of the rocker arm configured to selectively act on a valve bridge, the valve bridge configured to selectively engage a first exhaust valve and a second exhaust valve, the valve end of the rocker arm comprising:

a brake capsule disposed on the rocker arm and comprising:

a first plunger body selectively movable between a first position and a second position, the first plunger body extending in the first position to act on the first exhaust valve through the valve bridge, and a capsule locking mechanism comprising a selectively actuated locking pin configured to engage a groove in the first plunger body of the brake capsule, thereby constraining the first plunger body in a collapsed state when engine braking is disabled, to reduce redundant hydraulic fluid cycling through the brake capsule during non-braking operation; and a lost motion mechanism disposed on the rocker arm comprising a lost motion shaft and a hydraulic lash adjuster integrated into the lost motion mechanism, the lost motion shaft configured to translate along a lost motion receiving passage for selectively transmitting motion of the rocker arm to the valve bridge, wherein the hydraulic lash adjuster comprises a second plunger body integrated with a spigot coupled to a socket of the valve bridge, wherein a portion of the second plunger body is positioned between a bias member and the spigot, wherein the bias member extends beyond the second plunger body, and wherein the portion of the second plunger body abuts the lost motion shaft, wherein the hydraulic lash adjuster integrated into the lost motion mechanism is configured to continually compensate for lash between the lost motion shaft and the valve bridge during operation of the exhaust valve rocker arm assembly in the engine braking enabled mode and the engine braking disabled mode.

2. The exhaust valve rocker arm assembly of claim 1, wherein in the engine braking enabled mode, the first plunger body of the brake capsule is configured to operate in the first position, the first plunger body acting on the valve bridge during rotation of the rocker arm to a first angle and opening the first exhaust valve by a predetermined distance, the second exhaust valve remaining closed.

3. The exhaust valve rocker arm assembly of claim 2, wherein in the engine braking enabled mode and subsequent to opening the first exhaust valve by the predetermined distance, further rotation of the rocker arm causes the lost motion shaft to act on the valve bridge and open the second exhaust valve while further opening the first exhaust valve.

4. The exhaust valve rocker arm assembly of claim 2, wherein the brake capsule is a hydraulic brake capsule.

5. The exhaust valve rocker arm assembly of claim 4, wherein the hydraulic brake capsule comprises an actuator configured to selectively release oil pressure in the hydraulic brake capsule.

6. The exhaust valve rocker arm assembly of claim 5, wherein the first plunger body occupying the first position is associated with providing pressurized oil through a controllable hydraulic line, the pressurized oil acting on the actuator.

7. The exhaust valve rocker arm assembly of claim 5, wherein the actuator comprises a needle and a check ball, the needle comprising a longitudinal pin portion and a disk portion, the needle configured to selectively open the check ball based on pressurized oil acting on the disk portion.

8. The exhaust valve rocker arm assembly of claim 7, further comprising an oil discharge circuit configured to selectively depressurize oil under the disk portion of the needle.

9. The exhaust valve rocker arm assembly of claim 1, wherein the lost motion mechanism is longitudinally aligned with the center of the valve bridge.

10. The exhaust valve rocker arm assembly of claim 1, wherein the brake capsule is longitudinally aligned with the first exhaust valve.

11. The exhaust valve rocker arm assembly of claim 1, wherein in the engine braking disabled mode, the first plunger body is retracted to the second position and configured into a collapsible state, thereby preventing the first plunger body from exerting a valve opening force on the valve bridge, and the first exhaust valve and the second exhaust valve are configured to follow an exhaust lift profile motion transmitted to the valve bridge by the lost motion mechanism.

12. The exhaust valve rocker arm assembly of claim 1, wherein the locking mechanism is configured to selectively mechanically constrain the first plunger body to the second position in the engine braking disabled mode, and wherein the locking pin comprises a rounded engagement tip configured to seat against a shoulder of the groove of the first plunger body.

13. A method of operating a valvetrain system comprising an exhaust valve rocker arm assembly, the method comprising, in an engine braking enabled mode:

extending a first plunger body of a brake capsule to a first position, the exhaust valve rocker arm assembly comprising the brake capsule and a lost motion mechanism, the first plunger body in the first position acting on a valve bridge during rotation of a rocker arm to a first angle to open a first exhaust valve by a predetermined distance, a second exhaust valve remaining closed, wherein the brake capsule comprises a capsule locking mechanism comprising a selectively actuated locking pin configured to engage a groove in the first plunger body of the brake capsule, thereby constraining the first plunger body in a collapsed state when engine braking is disabled, to reduce redundant hydraulic fluid cycling through the brake capsule during non-braking operation; and causing a lost motion shaft of the lost motion mechanism to act on the valve bridge, subsequent to opening of the first exhaust valve by the predetermined distance and based on further rotation of the rocker arm, to open the second exhaust valve while further opening the first exhaust valve, wherein a hydraulic lash adjuster comprises a second plunger body integrated with a spigot coupled to a socket of the valve bridge, wherein a portion of the second plunger body is positioned between a bias member and the spigot, wherein the bias member extends beyond the second plunger body, and wherein the portion of the second plunger body abuts the lost motion shaft, while continually compensating for lash between the lost motion shaft and the valve bridge based on operation of the hydraulic lash adjuster integrated into the lost motion mechanism.

14. The method of claim 13, the method further comprising, in an engine braking disabled mode:

retracting the first plunger body to a second position, thereby preventing the first plunger body from exerting a valve opening force on the valve bridge, and constraining the first exhaust valve and the second exhaust valve to follow an exhaust lift profile motion transmitted to the valve bridge by the lost motion mechanism.

15. A valvetrain system of an engine, the valvetrain system capable of selectively engaging an engine braking enabled mode or an engine braking disabled mode, the valvetrain system comprising:

an exhaust camshaft provided with an engine braking profile;

an exhaust valve rocker arm assembly operatively coupled with the exhaust camshaft and selectively operable in at least the engine braking enabled mode and the engine braking disabled mode;

a valve bridge; and a plurality of exhaust valves comprising a first exhaust valve and a second exhaust valve, the plurality of exhaust valves configured to be selectively acted upon by the valve bridge, wherein the exhaust valve rocker arm assembly further comprises:

a rocker arm configured to rotate about a rocker shaft;

a brake capsule disposed on the rocker arm and comprising:

a first plunger body selectively movable between a first position and a second position, the first plunger body extending in the first position to act on the first exhaust valve through the valve bridge, and a capsule locking mechanism comprising a selectively actuated locking pin configured to engage a groove in the first plunger body of the brake capsule, thereby constraining the first plunger body in a collapsed state when engine braking is disabled, to reduce redundant hydraulic fluid cycling through the brake capsule during non-braking operation; and a lost motion mechanism disposed on the rocker arm comprising a lost motion shaft and a hydraulic lash adjuster integrated into the lost motion mechanism, the lost motion shaft configured to translate along a lost motion receiving passage for selectively transmitting motion of the rocker arm to the valve bridge, wherein the hydraulic lash adjuster comprises a second plunger body integrated with a spigot coupled to a socket of the valve bridge, wherein a portion of the second plunger body is positioned between a bias member and the spigot, wherein the bias member extends beyond the second plunger body, and wherein the portion of the second plunger body abuts the lost motion shaft.

16. The valvetrain system of claim 15, wherein in the engine braking enabled mode, the first plunger body of the brake capsule is configured to operate in the first position, the first plunger body configured to act on the valve bridge during rotation of the rocker arm to a first angle and open the first exhaust valve by a predetermined distance, the second exhaust valve remaining closed, and wherein subsequent to opening the first exhaust valve by the predetermined distance, further rotation of the rocker arm causes the lost motion shaft to act on the valve bridge and open the second exhaust valve while further opening the first exhaust valve.

17. The valvetrain system of claim 15, wherein in the engine braking disabled mode, the first plunger body is retracted to the second position, thereby preventing the first plunger body from exerting a valve opening force on the valve bridge, and the first exhaust valve and the second exhaust valve are configured to follow an exhaust lift profile motion transmitted to the valve bridge by the lost motion mechanism.

18. The valvetrain system of claim 15, wherein the brake capsule is a hydraulic brake capsule, and wherein the hydraulic brake capsule comprises an actuator configured to selectively release oil pressure in the hydraulic brake capsule.

19. The valvetrain system of claim 18, wherein the actuator comprises a needle and a check ball, the needle comprising a longitudinal pin portion and a disk portion, the needle configured to selectively open the check ball based on pressurized oil acting on the disk portion.

20. The valvetrain system of claim 15, wherein the lost motion mechanism is longitudinally aligned with the center of the valve bridge, and wherein the brake capsule is longitudinally aligned with the first exhaust valve.

* * * * *